US009812803B2

(12) United States Patent
Toyoda et al.

(10) Patent No.: US 9,812,803 B2
(45) Date of Patent: Nov. 7, 2017

(54) SOCKET

(71) Applicant: Panasonic Intellectual Property Management Co., Ltd., Osaka (JP)

(72) Inventors: Hiroyuki Toyoda, Osaka (JP); Satoru Tanaka, Osaka (JP); Kiwamu Shibata, Mie (JP); Noboru Hashimoto, Mie (JP); Kazuya Baba, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/997,004

(22) Filed: Jan. 15, 2016

(65) Prior Publication Data

US 2016/0226172 A1 Aug. 4, 2016

(30) Foreign Application Priority Data

Feb. 3, 2015 (JP) ..... 2015-019460

(51) Int. Cl.
*H01R 13/648* (2006.01)
*H01R 13/115* (2006.01)

(52) U.S. Cl.
CPC ..... *H01R 13/115* (2013.01)

(58) Field of Classification Search
CPC .. H01R 13/652; H01R 13/648; H01R 13/112; H01R 2103/00; H01R 25/006; H01R 23/725; H01R 23/7068
USPC ..... 439/106, 107, 682, 856, 924
See application file for complete search history.

(56) References Cited

U.S. PATENT DOCUMENTS 3,636,494 A * 1/1972 Smith ..... H01R 13/652 439/107
4,018,492 A * 4/1977 Eckart ..... H01R 13/652 439/106
6,109,937 A * 8/2000 Bonilla ..... H01R 13/652 439/107
6,227,883 B1 * 5/2001 Lee ..... H01R 13/652 439/106
8,133,064 B2 * 3/2012 Nishimura ..... H01R 4/44 439/107

FOREIGN PATENT DOCUMENTS

JP 2011-198745 A 10/2011
JP 2011-198751 A 10/2011
WO 2011/051781 A1 5/2011
WO 2011/073758 A1 6/2011

* cited by examiner

*Primary Examiner* — Hien Vu
(74) *Attorney, Agent, or Firm* — McDermott Will & Emery LLP

(57) ABSTRACT

A socket includes power-supply blade receivers and a grounding blade receiver for retaining power-supply plug blades and a grounding plug blade of a plug, respectively. Each of the power-supply blade receivers includes a power-supply retaining portion and a power-supply contact portion. The grounding blade receiver includes a grounding retaining portion and a grounding contact portion which is installed further on the upstream side in the insertion direction of the plug than a position which is spaced away from the power-supply contact portion to the downstream side in the insertion direction by less than the certain distance. The grounding retaining portion is spaced away by the certain distance or more from the power-supply retaining portion to the downstream side in the insertion direction.

13 Claims, 12 Drawing Sheets

SOCKET

CROSS-REFERENCE TO RELATED APPLICATIONS

This application is based upon and claims the benefit of priority from prior Japanese Patent Application No. 2015-019460, filed on Feb. 3, 2015, the entire contents of which are incorporated herein by reference.

FIELD

The present disclosure relates to a socket or a receptacle outlet.

BACKGROUND

Conventionally, a receptacle outlet includes blade receivers which hold plug blades of a plug therebetween to become electrically conductive with the plug, thereby supplying electric power to the plug (JP-A-2011-198745 A and JP-A-2011-198751).

FIGS. 14A and 14B illustrate a receptacle outlet A2 having a conventional blade receiving structure and a plug B2. Referring to FIG. 14A, the plug B2 includes a plug body 200 to be used by a user for gripping the plug B2, a pair of power-supply plug blades 201 which protrude forward from a leading end face 200A of the plug body 200 (only one of them is illustrated) and a grounding plug blade 203. The grounding plug blade 203 protrudes further forward than the power-supply plug blades 201.

The receptacle outlet A2 includes a receptacle main body 300 having a recessed portion 301 into which a leading end portion of the plug B2 is inserted. On a bottom face 301A of the recessed portion 301, there are installed a power-supply insertion hole 302 into which the power-supply plug blade 201 is inserted in a detachable manner and a grounding insertion hole 303 into which the grounding plug blade 203 is inserted in a detachable manner.

As illustrated in FIG. 14B, inside the receptacle main body 300 there is housed a power-supply blade receiving portion 304 which has a pair of conductive blade springs 305 for retaining and holding therebetween the power-supply plug blade 201 which is inserted into the receptacle main body 300 through the power-supply insertion hole 302. Inside the receptacle main body 300, there is also housed a grounding blade receiving portion 306 which has a pair of conductive blade springs 307 for retaining and holding therebetween the grounding plug blade 203 which is inserted into the receptacle main body 300 through the grounding insertion hole 303.

When the plug B2 is inserted into the receptacle outlet A2, for the purpose of preventing electric shock, first, the grounding plug blade 203 which has protruded further forward than the power-supply plug blade 201 is brought into contact with the grounding blade receiving portion 306. Next, the grounding plug blade 203 is retained by the grounding blade receiving portion 306 and, then, the power-supply plug blade 201 is retained by the power-supply blade receiving portion 304.

SUMMARY

In the conventional receptacle outlet A2, there is a case that after the grounding plug blade 203 has been retained by the grounding blade receiving portion 306, the power-supply plug blade 201 comes into contact with the power-supply blade receiving portion 304 in a state that they are in contact with each other at a small contact area (point contact). When the plug B2 has been retained by the receptacle outlet A2 in the above state that they are in point contact with each other, a resistance resulting from contact between the power-supply plug blade 201 and the power-supply blade receiving portion 304 may be increased to generate high heat.

An object of the present disclosure is to provide a socket (receptacle outlet) which is arranged so as to be able to suppress heat between a plug and the socket.

One aspect of the present invention is a socket for use with a plug including a plug body, a pair of power-supply plug blades that protrude from a leading end face of the plug body, and a grounding plug blade that protrudes from the leading end face by a certain distance from the power-supply plug blades. The socket includes a pair of power-supply blade receivers adapted to retain the pair of power-supply plug blades, and a grounding blade receiver adapted to retain the grounding plug blade. Each of the power-supply blade receivers includes a power-supply retaining portion configured to elastically and conductively retain the corresponding power-supply plug blade and a power-supply contact portion which is installed further on the upstream side in the insertion direction of the corresponding power-supply plug blade and the grounding plug blade than the power-supply retaining portion to contact with the corresponding power-supply plug blade. The grounding blade receiver includes a grounding retaining portion configured to elastically and conductively retain the grounding plug blade and a grounding contact portion which is installed further on the upstream side in the insertion direction than the grounding retaining portion to contact with the grounding plug blade. The grounding contact portion is installed further on the upstream side in the insertion direction than a position which is spaced away from the power-supply contact portion to the downstream side in the insertion direction by less than the certain distance. The grounding retaining portion is spaced away by the certain distance or more from the power-supply retaining portion to the downstream side in the insertion direction.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

Figure 1A:
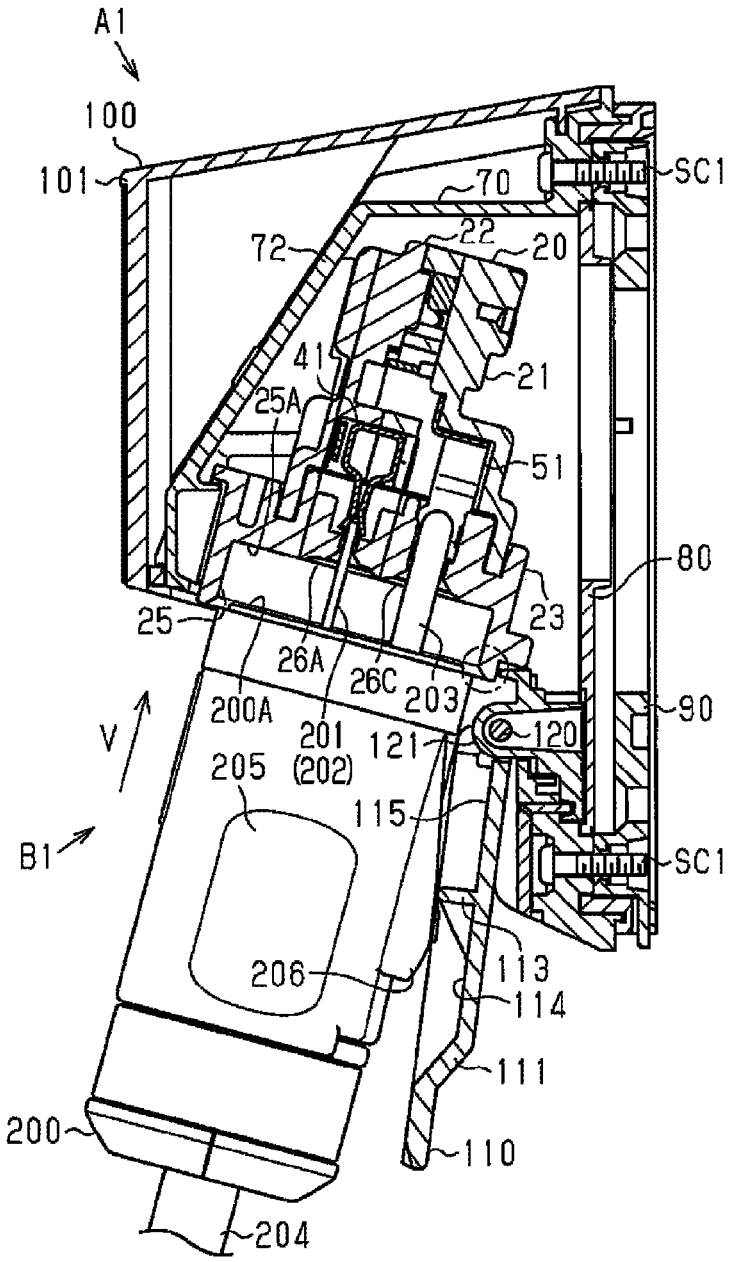
FIG. 1A is a longitudinal sectional view of a receptacle outlet of an embodiment.
Figure 1B:
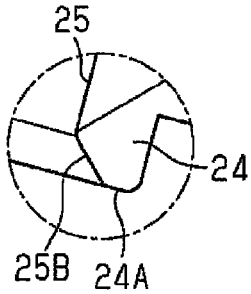
FIG. 1B is a partially enlarged sectional view of the receptacle outlet in FIG. 1A.
Figure 1B:
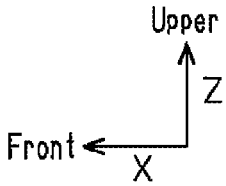

One embodiment of the receptacle outlet (socket) will be described. As illustrated in FIG. 1A, a plug B1 is inserted into a receptacle outlet A1. The outlet A1 is installed, for example, on an outdoor wall surface of a house. FIGS. 1A and 1B illustrate a state that the plug B1 is inserted into a midpoint of the outlet A1.

Figure 9B:
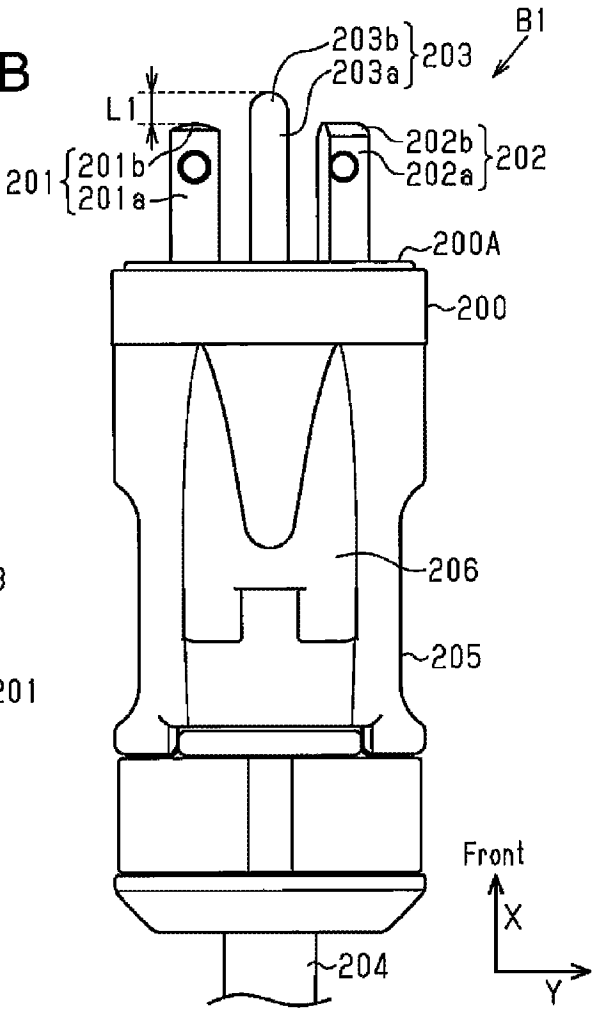
FIG. 9B is a plan view illustrating a structure of the plug when viewed from below.
Figure 9A:
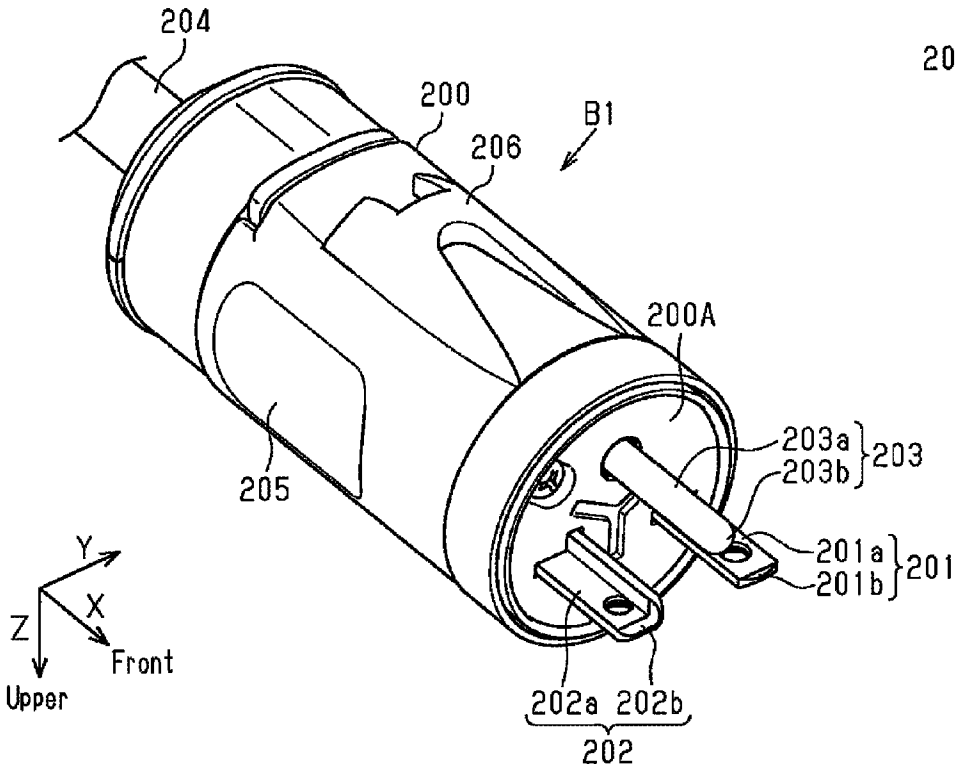
FIG. 9A is a perspective view of a plug when viewed from below.

First, with reference to FIGS. 9A and 9B, a description will be given of a structure of the plug B1 which is inserted into the outlet A1. In the description of FIGS. 9A and 9B, "front-and-back direction," "lateral direction" and "vertical direction" represent respectively "front-and-back direction X," "lateral direction Y" and "vertical direction Z" indicated with arrows, unless otherwise specified.

As illustrated in FIG. 9A, the plug B1 includes a plug body 200 which is formed substantially in a cylindrical shape so that a user can grip the plug B1. The plug B1 includes a pair of power-supply plug blades 201, 202 which protrude forward from a leading end face 200A of the plug body 200 and a grounding plug blade 203 which protrudes forward from the leading end face 200A and protrudes further forward than the power-supply plug blades 201, 202. At the rear of the plug body 200, there is installed a cable 204 which supplies electric power received by the power-supply plug blades 201, 202 and the grounding plug blade 203 to a device (not illustrated). The plug body 200 is molded by injection-molding by using a resin material.

The pair of power-supply plug blades 201, 202 are arrayed so as to be adjacent to each other in the lateral direction Y. The grounding plug blade 203 is disposed between the pair of power-supply plug blades 201, 202 in the lateral direction Y and also below the power-supply plug blades 201, 202. The power-supply plug blade 201 includes a body portion 201*a* which is formed substantially in a rectangular shape in which the lateral direction Y thereof is longitudinal in a planar view in the front-and-back direction X and a leading end portion 201*b* in which a corner portion of the leading end is chamfered. The power-supply plug blade 202 includes a body portion 202*a* which is formed in an L-letter shape in a planar view in the front-and-back direction X and a leading end portion 202*b* in which a corner portion of the leading end is chamfered. The grounding plug blade 203 is formed in a round-pin shape. The grounding plug blade 203 includes a body portion 203*a* which is formed in a cylindrical shape and a leading end portion 203*b* which is formed substantially in a hemi-sphere shape.

As illustrated in FIG. 9B, the amount that the grounding plug blade 203 protrudes from the leading end face 200A is greater by a distance L1 than the amount that the power-supply plug blades 201, 202 protrude from the leading end face 200A. Here, in the present embodiment, the leading end portion 203*b* of the grounding plug blade 203 is set so as to be equal in length to the leading end portions 201*b*, 202*b* of the power-supply plug blades 201, 202. Therefore, the leading end of the body portion 203*a* of the grounding plug blade 203 protrudes forward by the distance L1 from the leading ends of the body portions 201*a*, 202*a* of the power-supply plug blades 201, 202.

As illustrated in FIG. 9A, the plug body 200 is provided on both side faces thereof at the center portion in the front-and-back direction X a gripping portion 205 which is formed in a flat shape and on which the fingers of a user make contact and at the lower part of the plug body 200 a protruding portion 206 which protrudes downward.

Then, with reference to FIG. 1A to FIG. 8, a description will be given of a structure of the outlet A1.

As illustrated in FIGS. 1A and 1B, the outlet A1 includes an receptacle main body 10 which has insertion ports 26 (refer to FIG. 3) into which the power-supply plug blades 201, 202 and the grounding plug blade 203 are inserted and a shutter opening/closing mechanism 11 which is installed on the receptacle main body 10 to perform opening/closing operations of the insertion ports 26.

In the following description, a direction which specifies the front side and the back side of a wall surface on which the outlet A1 is installed is given as "front-and-back direction X," a direction that is along the perpendicular direction is given as "vertical direction Z" and a direction that is orthogonal to both the front-and-back direction X and the vertical direction Z is given as "lateral direction Y." Further, in the front-and-back direction X, a direction that moves from the front side of the wall surface to the outlet A1 is given as "forward" and a direction that moves to the back side of the wall surface is given as "rearward." The "front-and-back direction X," the "lateral direction Y" and the "vertical direction Z" in FIGS. 1A to 8 are different from the "front-and-back direction X," the "lateral direction Y" and the "vertical direction Z" in FIGS. 9A and 9B.

First, a description will be given of a structure of the receptacle main body 10.

The receptacle main body 10 includes an outlet block 20, a body 70, a waterproof packing (packing) 80, an attachment frame 90 and a decorative cover 100.

When a wire (not illustrated) and the plug B1 are connected, the outlet block 20 supplies electric power from the wire to the plug B1. The body 70 includes a main body portion 71 which is a rectangular frame body and a retaining portion 72 which protrudes forward from the main body portion 71. The outlet block 20 is housed and retained in the retaining portion 72.

The packing 80 is placed between the wall surface and the body 70 and disposed rearward of the body 70. The packing 80 includes a main body portion 81 which is a rectangular frame body and a lid portion 82 which covers a front face of the main body portion 81. A wire through hole 83 which penetrates through the lid portion 82 in the front-and-back direction X is installed at an upper part of the lid portion 82. A wire arranged behind the wall surface is inserted into the wire through hole 83. A step portion 84 is installed over a connection portion of the entire outer periphery of the lid portion 82 with the main body portion 81. The body 70 and the packing 80 are fitted to each other by the step portion 84.

Both the body 70 and the waterproof packing 80 which have been so far described are fixed with a screw member SC1 to the attachment frame 90 disposed behind the wall surface.

The decorative cover 100 includes a peripheral wall portion 101 which covers the retaining portion 72 of the body 70 from forward and laterally and an upper wall 102 which covers an upper part of the peripheral wall portion 101. The decorative cover 100 is formed by the peripheral wall portion 101 and the upper wall 102 so as to be opened downward.

Next, a description will be given of a structure of the outlet block 20.

Figure 2:
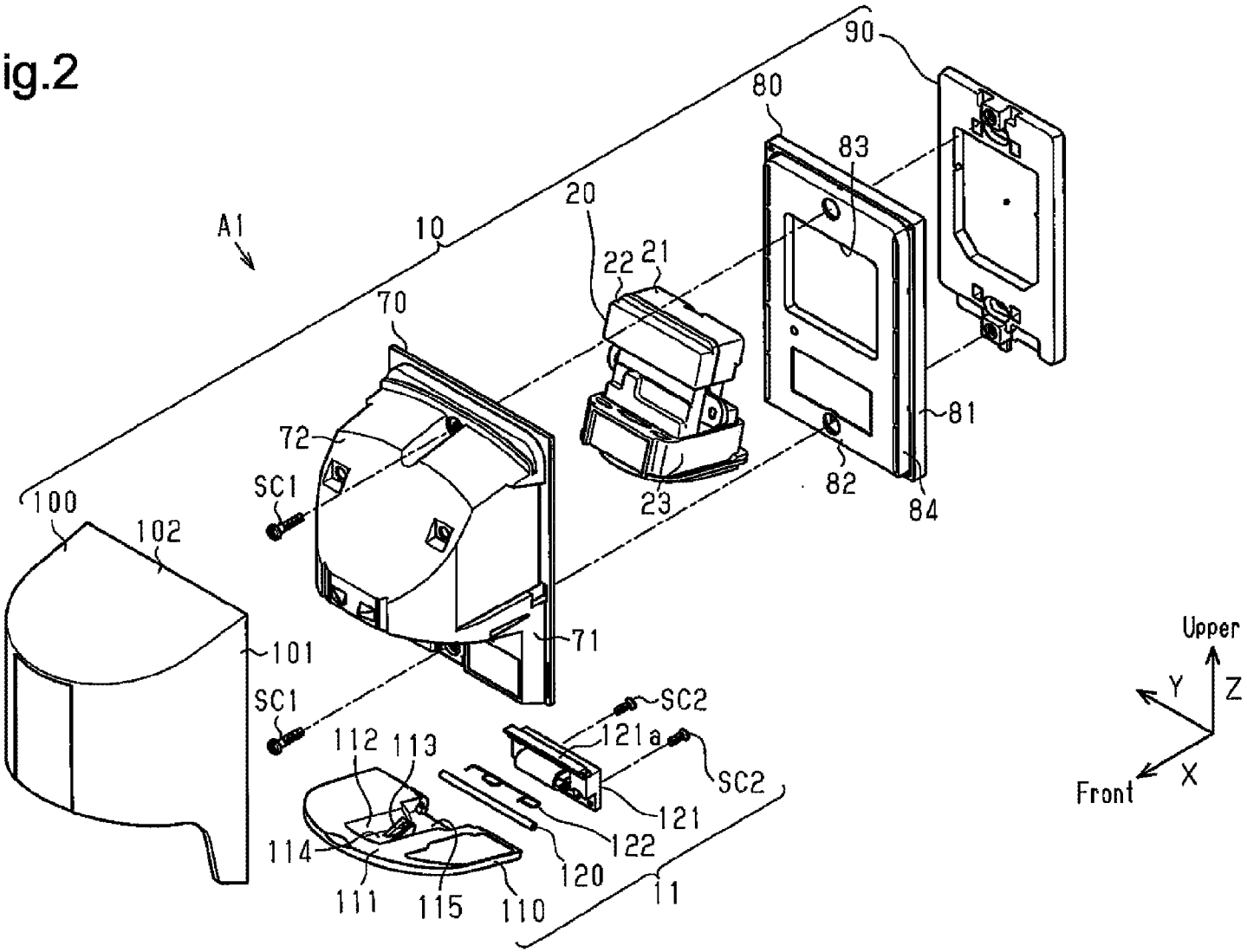
FIG. 2 is an exploded perspective view of the receptacle outlet of the embodiment.
Figure 3:
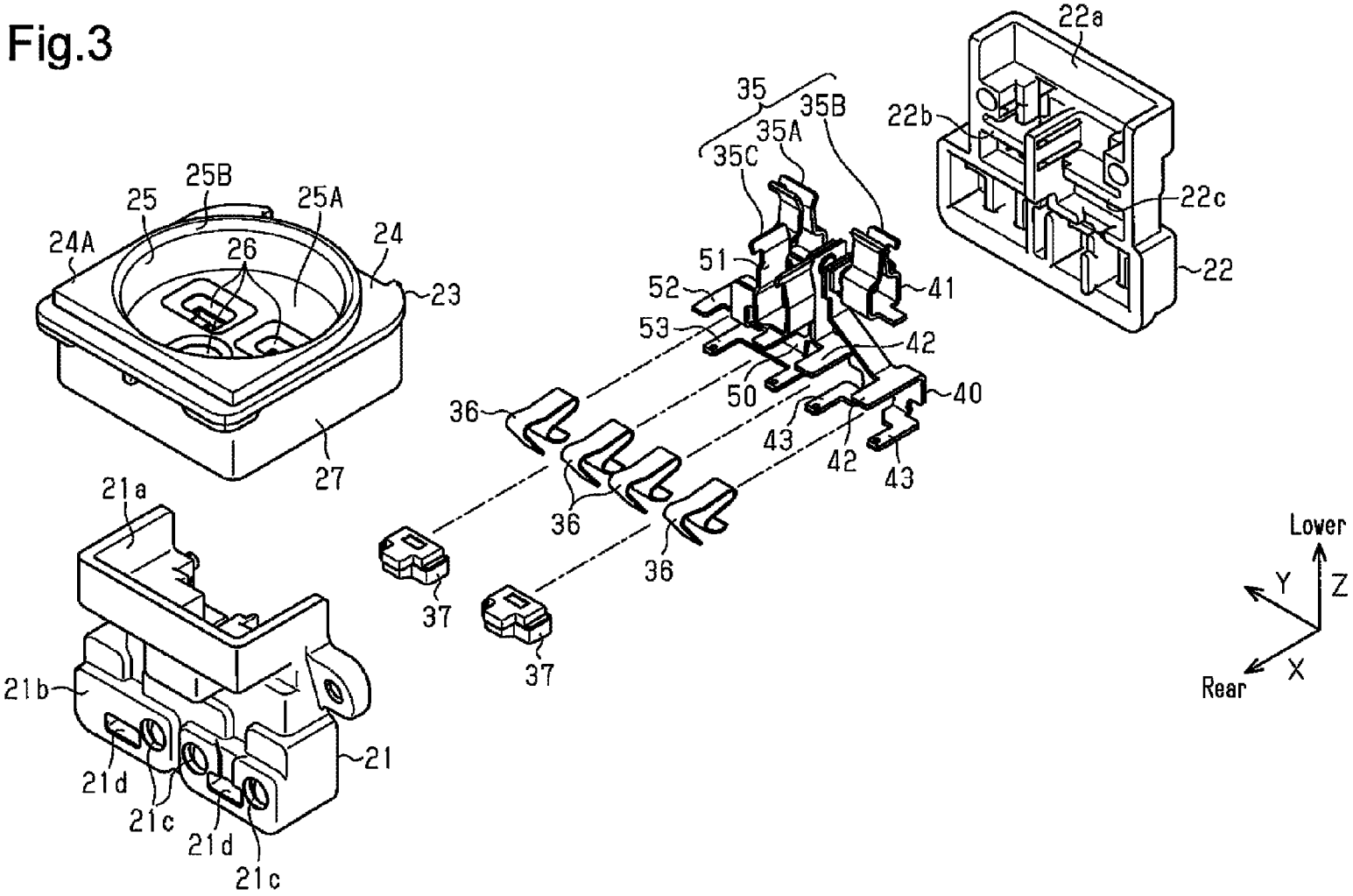
FIG. 3 is an exploded perspective view of an outlet block of the embodiment.

As illustrated in FIG. 3, the outlet block 20 includes an outlet body 21 which is a cabinet retained by the body 70 (refer to FIG. 2), an outlet cover 22 and a socket cover 23. The outlet body 21, the outlet cover 22 and the socket cover 23 are molded by injection-molding by using a resin material. Three terminal plates 35, four locking springs 36 and two release buttons 37 are housed inside an internal space formed with the outlet body 21, the outlet cover 22 and the socket cover 23.

The outlet body 21 and the outlet cover 22 are respectively provided with fixing portions 21*a*, 22*a* which fix them by being fitted into the socket cover 23.

A bottom wall 21*b* of the outlet body 21 includes wire insertion holes 21*c*, each of which penetrates through the bottom wall 21*b* in the front-and-back direction X and is also communicatively connected to the internal space formed with the outlet body 21 and the outlet cover 22. A wire is inserted through the wire insertion hole 21*c*. The bottom wall 21*b* includes operation holes 21*d*, each of which penetrates through the bottom wall 21*b* in the front-and-back direction X to operate the release button 37.

The socket cover 23 includes a main body portion 24 which is formed substantially in a quadrilateral shape in a planar view in the vertical direction Z. There is installed on a lower face 24A of the main body portion 24 a recessed portion 25 which is formed in a round shape in a planar view in the vertical direction Z and recessed upward from the lower face 24A. The leading end portion of the plug body 200 can be inserted through the recessed portion 25. The insertion ports 26 are installed on a bottom face 25A of the recessed portion 25. That is, the bottom face 25A of the recessed portion 25 is used as an insertion face on which the insertion ports 26 of the outlet A1 are formed.

As illustrated in FIG. 1B, a corner portion 25B between an inner wall of the recessed portion 25 and the lower face 24A (that is, an opening edge portion of the recessed portion 25) is chamfered over the entire periphery. Therefore, the recessed portion 25 at the corner portion 25B is increased in opening diameter from the bottom face 25A side of the recessed portion 25 to the lower face 24A. The corner portion 25B is subjected to C chamfering.

Figure 4B:
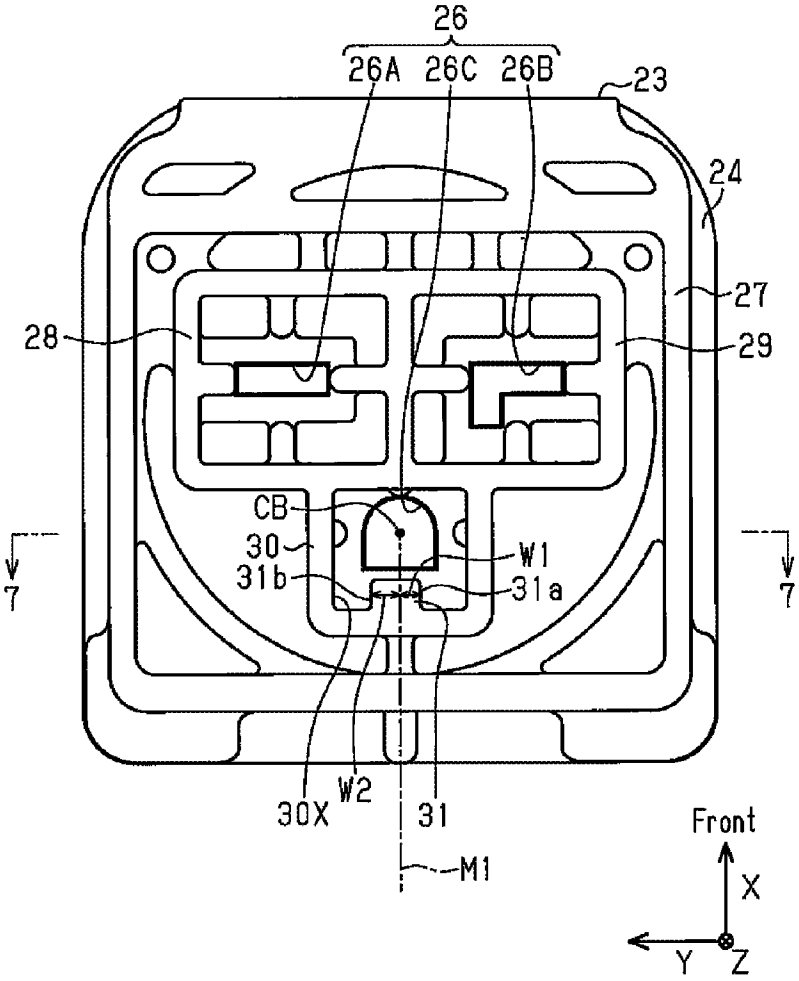
FIG. 4B is a plan view illustrating the structure of the socket cover when viewed from above.
Figure 4A:
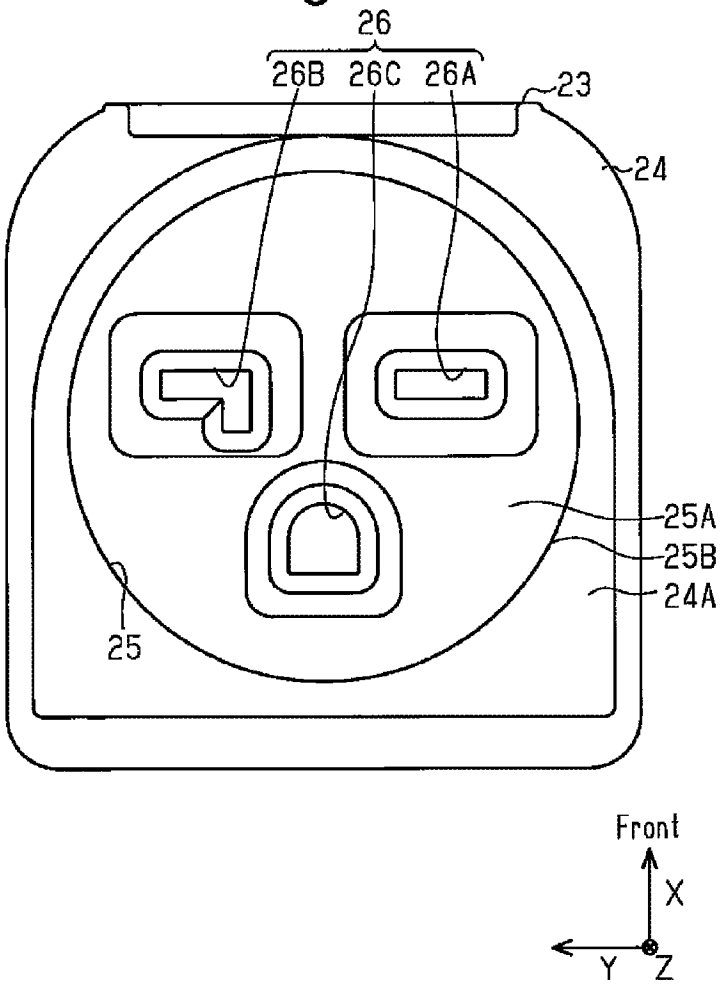
FIG. 4A is a plan view illustrating a structure of a socket cover when viewed from below.

As illustrated in FIG. 4A, the insertion ports 26 are respectively provided with a power-supply insertion hole 26A which is formed in a rectangular shape in which the lateral direction Y thereof is longitudinal in a planar view in the vertical direction Z, a power-supply insertion hole 26B which is formed in an L-letter shape and a grounding insertion hole 26C which is formed substantially in a round shape. The power-supply insertion holes 26A, 26B are arrayed so as to be adjacent to each other in the lateral direction Y. The grounding insertion hole 26C is installed between the power-supply insertion holes 26A, 26B in the lateral direction Y and also further rearward than the power-supply insertion holes 26A, 26B. The power-supply plug blade 201 which is formed in a flat plate shape (refer to FIGS. 9A and 9B) is inserted into the power-supply insertion hole 26A so as to be inserted in a detachable manner. And, the power-supply plug blade 202 which is formed in an L-letter shape (refer to FIG. 9A) is inserted into the power-supply insertion hole 26B so as to be inserted in a detachable manner. The grounding plug blade 203 which is formed in a round-pin shape (refer to FIGS. 9A and 9B) is inserted into the grounding insertion hole 26C so as to be inserted in a detachable manner.

As illustrated in FIG. 4B, a peripheral wall surface 27 which is fitted into the fixing portions 21*a*, 22*a* (refer to FIG. 3) is installed on an upper face of the main body portion 24 of the socket cover 23. An internal space surrounded by the peripheral wall surface 27 is provided with a partition wall 28 which surrounds the power-supply insertion hole 26A, a partition wall 29 which surrounds the power-supply insertion hole 26B and a partition wall 30 which surrounds the grounding insertion hole 26C. The partition wall 30 forms a recessed portion 30X. There is installed a rib 31 which protrudes to the grounding insertion hole 26C from the partition wall 30 installed further rearward than the grounding insertion hole 26C in a position further rearward than the grounding insertion hole 26C inside the recessed portion 30X.

The terminal plate 35 illustrated in FIG. 3 includes a pair of power-supply terminal plates 35A, 35B arrayed so as to be adjacent to each other in the lateral direction Y and one grounding terminal plate 35C which is disposed between the power-supply terminal plates 35A, 35B in the lateral direction Y and also further rearward than the power-supply terminal plates 35A, 35B.

Each of the power-supply terminal plates 35A, 35B includes a base portion 40 which is formed in a flat plate shape along the vertical direction Z and the lateral direction Y and a power-supply blade receiving portion 41 which extends downward from the base portion 40. Each of the power-supply terminal plates 35A, 35B is also provided with a locking spring contact portion 42 which extends rearward from a lower end portion of the base portion 40 and a wire contact portion 43 which extends rearward from an upper end portion of the base portion 40.

The grounding terminal plate 35C includes a base portion 50 which is formed in a flat plate shape along the vertical direction Z and the lateral direction Y, a grounding blade receiving portion 51 which extends downward from the base portion 50, a locking spring contact portion 52 which extends rearward from a lower end portion of the base portion 50 and a wire contact portion 53 which extends rearward from an upper end portion of the base portion 50. Two of the locking spring contact portions 52 and two of the wire contact portions 53 are installed on the grounding terminal plate 35C so as to be spaced away from each other in the lateral direction Y.

The locking spring 36 is housed between each of the locking spring contact portions 42, 52 and each of the wire contact portions 43, 53 in the vertical direction Z. A wire which is inserted through the wire insertion hole 21*c* of the outlet body 21 is brought into contact with the locking spring 36. The wire is pressed by the locking spring 36 toward each of the wire contact portions 43, 53. Thereby, the power-supply terminal plates 35A, 35B and the grounding terminal plate 35C are electrically connected to the wire.

The release button 37 is disposed between the locking springs 36 arrayed in the lateral direction Y. The release button 37 is operated through the operation hole 21*d* when the wire is released from the outlet block 20.

Figure 5:
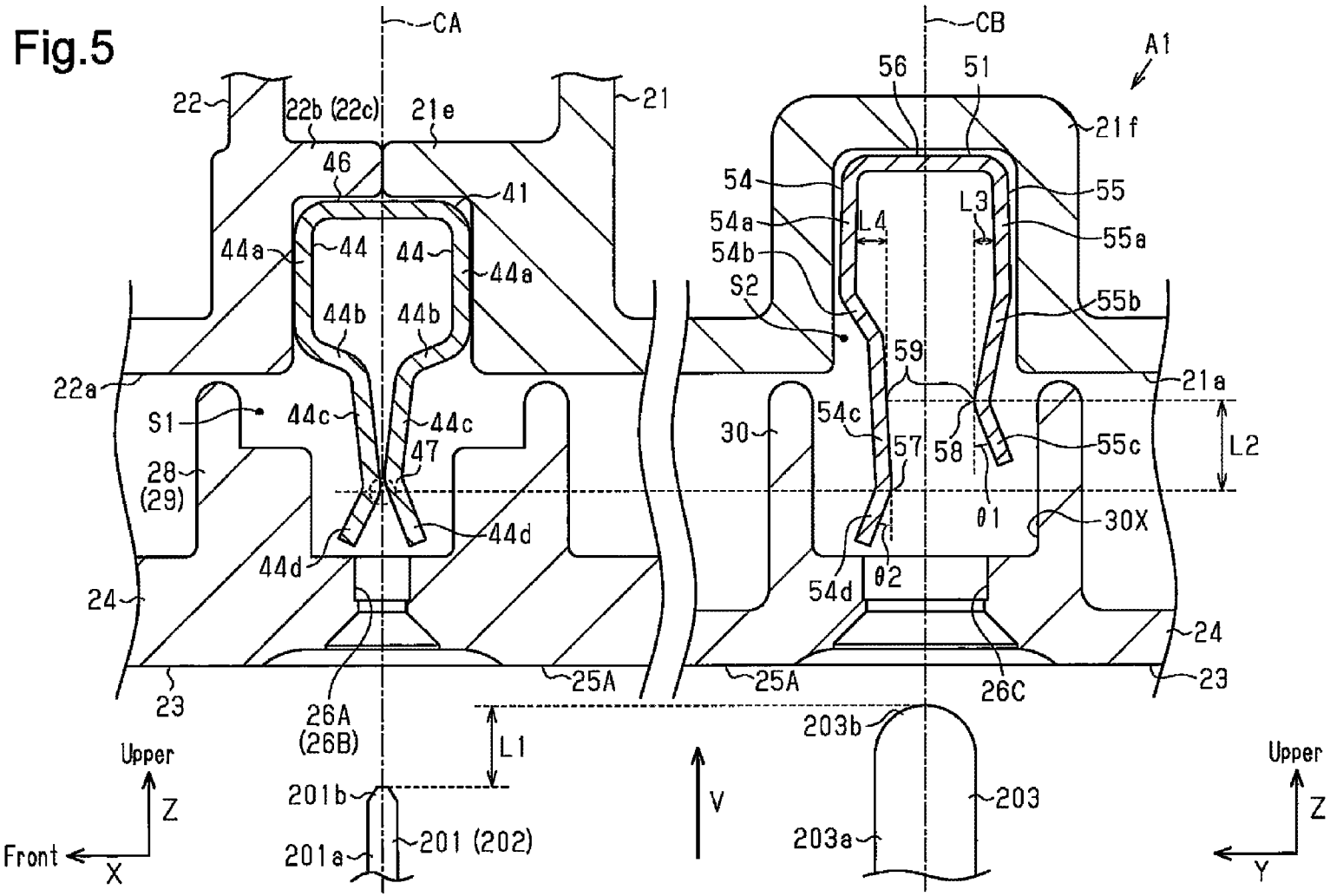
FIG. 5 is a developed view in which the outlet block is developed on a plane and shown.

Next, with reference to FIG. 5, a description will be given of a structure of the power-supply blade receiving portion 41 of each of the power-supply terminal plates 35A, 35B. Since the power-supply blade receiving portion 41 of the power-supply terminal plate 35B is similar in structure to the power-supply blade receiving portion 41 of the power-supply terminal plate 35A illustrated in FIG. 5, a detailed description thereof will be omitted here.

The power-supply blade receiving portion 41 of the power-supply terminal plate 35A is disposed inside a housing chamber S1 which is formed with a partition wall 21*e* installed on an inner wall of the outlet body 21, a partition wall 22*b* installed on an inner wall of the outlet cover 22 and a partition wall 28 installed on the socket cover 23. The power-supply blade receiving portion 41 is disposed in a position corresponding to the power-supply insertion hole 26A formed in a rectangular shape. The power-supply insertion hole 26A is communicatively connected to the housing chamber S1. Then, the power-supply blade receiving portion 41 retains with elastic force the flat-plate shaped power-supply plug blade 201 which is inserted through the power-supply insertion hole 26A, thereby becoming conductive with the power-supply plug blade 201.

In the following description, a direction in which the power-supply plug blades 201, 202 and the grounding plug blade 203 are inserted into the outlet A1 is given as "insertion direction V." The side of the insertion ports 26 into which insertion of each of the power-supply plug blades 201, 202 and the grounding plug blade 203 is started in the insertion direction V is given as "upstream," and the internal side of the outlet A1 is given as "downstream." Further, an axis which is in alignment with a center axis of the power-supply plug blade 201 when the power-supply plug blade 201 is retained by the power-supply blade receiving portion 41 is given as an insertion axis CA. The insertion axis CA is in alignment with a virtual line which runs through the center of the power-supply insertion hole 26A and extends along the insertion direction V, in a planar view in the vertical direction Z.

The power-supply blade receiving portion 41 includes a pair of holding plates 44 which oppose each other to elastically hold the power-supply plug blade 201 therebetween and a coupling portion 46 which couples base end portions of the pair of holding plates 44 (that is, the end portions on the downstream side in the insertion direction V). The power-supply blade receiving portion 41 is formed with a conductive plate material which has spring characteristics.

The pair of holding plates 44 are formed roughly in such a manner that they come close to each other from downstream to upstream in the insertion direction V and are thereafter spaced away again. Specifically, each of the holding plates 44 includes a base portion 44*a* connected to the coupling portion 46, bending portions 44*b*, 44*c* which are bent from the base portion 44*a* to the insertion axis CA and a guide portion 44*d* which is bent from the bending portion 44*c* in a direction that is spaced away from the insertion axis CA.

The base portion 44*a* is formed so as to extend downward from the coupling portion 46 along the insertion direction V. The pair of base portions 44*a* are disposed so as to oppose each other substantially in parallel. The base portions 44*a* rise from the coupling portion 46, thereby generating an urging force to the holding plates 44 for holding the power-supply plug blade 201 therebetween. The coupling portion 46 structurally connects the both holding plates 44 to form a fixed point, with an interval between the base end portions of the both holding plates 44 being kept constant, thereby contributing to generation of the urging force.

A pair of bending portions 44*b* are bent in such a direction that they come close to each other as they move from the leading end portion of the base portion 44*a* to the upstream side in the insertion direction V. A pair of bending portions 44*c* are bent in such a direction that they come close to each other as they move from the leading end portion of the bending portion 44*b* to the upstream side with respect to the insertion direction V. The bending portion 44*b* is formed in such a manner that an inclination angle thereof in the insertion direction V is wider than that of the bending portion 44*c*. The leading end portions of the pair of bending portions 44*c* oppose each other at an interval narrower than the plate thickness of the body portion 201*a* of the power-supply plug blade 201.

A pair of guide portions 44*d* are bent so as to guide insertion of the power-supply plug blade 201 in such a direction that they are spaced away from each other as they move from downstream to upstream in the insertion direction V. The leading end portion of each of the guide portions 44*d* is given as a free end. The pair of guide portions 44*d* are served as power-supply contact portions which first come into contact with the power-supply plug blade 201 inserted through the power-supply insertion hole 26A.

Then, in the power-supply blade receiving portion 41, a part where the interval between the pair of holding plates 44 becomes the narrowest (that is, a part at which the bending portion 44*c* is connected to the guide portion 44*d*) is given as a power-supply retaining portion 47 which elastically comes into contact with the power-supply plug blade 201 and becomes conductive. That is, the power-supply retaining portion 47 which is bent in a less-than sign shape in a mutually coming-close direction is installed on the pair of holding plates 44.

Next, with reference to FIGS. 5 and 6, a description will be given of a structure of the grounding blade receiving portion 51.

The grounding blade receiving portion 51 is disposed in a housing chamber S2 which is formed with a partition wall 21*f* installed on an inner wall of the outlet body 21 and the recessed portion 30X installed on the socket cover 23. The grounding blade receiving portion 51 is disposed in a position corresponding to the grounding insertion hole 26C which is formed substantially in a round shape. The grounding insertion hole 26C is communicatively connected to the housing chamber S2. Then, the grounding blade receiving portion 51 retains with elastic force the grounding plug blade 203 which is formed in a round-pin shape and inserted through the grounding insertion hole 26C, thereby becoming conductive with the grounding plug blade 203.

In the following description, an axis which is aligned with the center axis of the grounding plug blade 203 when the grounding plug blade 203 is retained by the grounding blade receiving portion 51 is given as an insertion axis CB. The insertion axis CB is aligned with a virtual line which extends along the insertion direction V by passing through the center of the grounding insertion hole 26C in a planar view in the vertical direction Z.

The grounding blade receiving portion 51 includes a pair of grounding pieces 54, 55 which oppose each other to elastically hold the grounding plug blade 203 therebetween and a coupling portion 56 which couples the base end portion of the grounding piece 54 with the base end portion of the grounding piece 55. The grounding blade receiving portion 51 is formed with a conductive plate material which has spring characteristics. Here, the end portions opposite to the base end portions (leading end portions) of the grounding pieces 54, 55 (that is, the upstream side in the insertion direction V) are given as free ends.

A length of the grounding piece 55 from the base end portion to the leading end portion thereof (an entire length) is shorter than a length of the grounding piece 54 from the base end portion to the leading end portion thereof (an entire length). Specifically, the entire length of the grounding piece 55 is shorter than that of the grounding piece 54 by a distance L1 which is a difference in the protrusion amount between the power-supply plug blade 201 and the grounding plug blade 203.

The grounding piece 54 includes a base portion 54*a* which is connected to the coupling portion 56, bending portions 54*b*, 54*c* which are bent from the base portion 54*a* to the insertion axis CB and a guide portion 54*d* which is bent from the bending portion 54*c* in a direction that is spaced away from the insertion axis CB.

The grounding piece 55 includes a base portion 55*a* which is connected to the coupling portion 56, a bending portion 55*b* which is bent from the base portion 55*a* to the insertion axis CB and a guide portion 55*c* which is bent from the bending portion 55*b* in a direction which is spaced away from the insertion axis CB.

The base portions 54*a*, 55*a* are formed so as to extend downward from the coupling portion 56 along the insertion direction V. The pair of base portions 54*a*, 55*a* are disposed so as to oppose each other substantially in parallel. The base portions 54*a*, 55*a* rise from the coupling portion 56, thereby generating an urging force to the pair of grounding pieces 54, 55 which hold the grounding plug blade 203 therebetween. The coupling portion 56 structurally connects the both grounding pieces 54, 55 to form a fixed point, with an interval between the base end portions of the both grounding pieces 54, 55 being kept constant, thereby contributing to generation of the urging force.

The bending portion 54*b* is bent so as to come close to the grounding piece 55 as it moves from the leading end portion of the base portion 54*a* to the upstream side in the insertion direction V. The bending portion 54*c* is bent so as to come close to the grounding piece 55 as it moves from the leading end portion of the bending portion 54*b* to the upstream side in the insertion direction V. The bending portion 54*b* is formed so that an inclination angle thereof with respect to the insertion direction V is greater than that of the bending portion 54*c*.

The guide portion 54*d* is bent so as to be spaced away from the grounding piece 55 (the insertion axis CB) as it moves from the leading end portion of the bending portion 54*c* to the upstream side in the insertion direction V. Therefore, a connection portion 57 which connects the bending portion 54*c* with the guide portion 54*d* is bent so as to give a less-than sign shape in a direction moving close to the insertion axis CB. Of the grounding piece 54, the connection portion 57 is a part which comes closest to the insertion axis CB. Then, at the grounding blade receiving portion 51, the connection portion 57 and the guide portion 54*d* are given as grounding contact portions with which the grounding plug blade 203 inserted through the grounding insertion hole 26C is first brought into contact.

In the present embodiment, the connection portion 57 of the grounding blade receiving portion 51 and the power-supply retaining portion 47 of the power-supply blade receiving portion 41 are disposed so as to be on the same plane orthogonal to the insertion axes CA, CB. That is, a length from the bottom face 25A to the connection portion 57 along the insertion direction V is equal to a length from the bottom face 25A to the power-supply retaining portion 47 along the insertion direction V. Further, the leading end portion of the guide portion 54*d* and the leading end portion of the guide portion 44*d* are disposed so as to be on the same plane orthogonal to the insertion axes CA, CB.

On the other hand, the bending portion 55*b* of the grounding piece 55 is bent so as to come close to the grounding piece 54 as it moves from the leading end portion of the base portion 55*a* to the upstream side in the insertion direction V. The bending portion 55*b* is formed so that an inclination angle thereof with respect to the insertion direction V is smaller than that of the bending portion 54*b*. The guide portion 55*c* is bent so as to be spaced away from the insertion axis CB as it moves from the leading end portion of the bending portion 55*b* to the upstream side in the insertion direction V. Therefore, a connection portion 58 which connects the bending portion 55*b* with the guide portion 55*c* is bent so as to form a less-than sign shape in a direction that comes close to the grounding piece 54 and the insertion axis CB. The connection portion 58 is installed so as to oppose a midpoint part of the bending portion 54*c*. A part at which the connection portion 58 opposes the bending portion 54*c* is a part at which an interval between the pair of grounding pieces 54, 55 becomes the narrowest, and they oppose each other at an interval narrower than the diameter of the body portion 203*a* of the grounding plug blade 203. Then, at the grounding blade receiving portion 51, a part at which the connection portion 58 opposes the bending portion 54*c* is given as a grounding retaining portion 59 which elastically comes into contact with the grounding plug blade 203 and becomes conductive. The grounding retaining portion 59 is installed further on the downstream side in the insertion direction V than the power-supply retaining portion 47 by a distance L2 equal to or more than the distance L1 which is a difference in the protrusion amount between the grounding plug blade 203 and the power-supply plug blade 201. In the present embodiment, the distance L2 is set to be longer than the distance L1.

In the grounding retaining portion 59, a first protrusion amount L3 which is a distance from the base end portion of the grounding piece 55 to the connection portion 58 toward the grounding piece 54 is less than a second protrusion amount L4 which is a distance from the base end portion of the grounding piece 54 to the bending portion 54*c* toward the grounding piece 55. Specifically, the protrusion amount L3 is less than the protrusion amount L4 so that contact pressures of the grounding piece 54 and the grounding piece 55 different in length acting on the grounding plug blade 203 are made equal. Therefore, in the grounding retaining portion 59, a clearance between the connection portion 58 and the insertion axis CB is longer than a clearance between the bending portion 54*c* and the insertion axis CB. Adjustment is made for an inclination angle of the bending portion 55*b*, an inclination angle of each of the bending portions 54*b*, 54*c*, a length of each of the bending portions 54*b*, 54*c* and the like, thus making it possible to adjust the protrusion amount L3 and the protrusion amount L4.

Further, an aperture angle of the guide portion 55*c* with respect to the insertion axis CB (inclination angle) θ1 is set so as to be equal in angle to an aperture angle of the guide portion 54*d* with respect to the insertion axis CB (inclination angle) θ2. In other words, the aperture angle θ1 of the guide portion 55*c* with respect to a virtual line (refer to the dashed line) extending along the insertion direction V is set so as to be equal in angle to the aperture angle θ2 of the guide portion 54*d* with respect to the virtual line.

Figure 6:
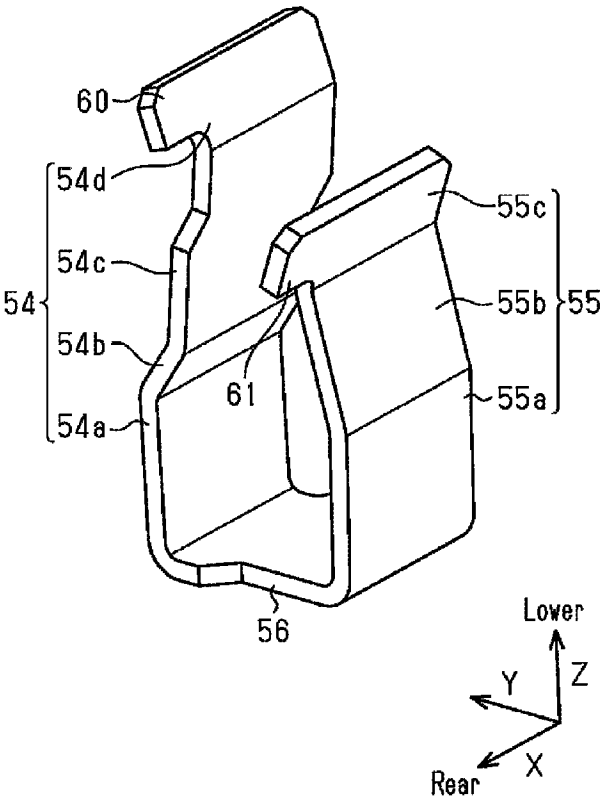
FIG. 6 is a perspective view of a grounding blade receiving portion.

As illustrated in FIG. 6, the guide portion 54*d* includes an extension portion 60 which extends further rearward than the bending portion 54*c*. Similarly, the guide portion 55*c* includes an extension portion 61 which extends further rearward than the bending portion 55*b*. The extension portions 60, 61 are disposed further rearward than the grounding insertion hole 26C (refer to FIG. 5). That is, the extension portions 60, 61 are disposed in a position which is not overlapped with the grounding insertion hole 26*c* in a planar view in the vertical direction Z.

Figure 7:
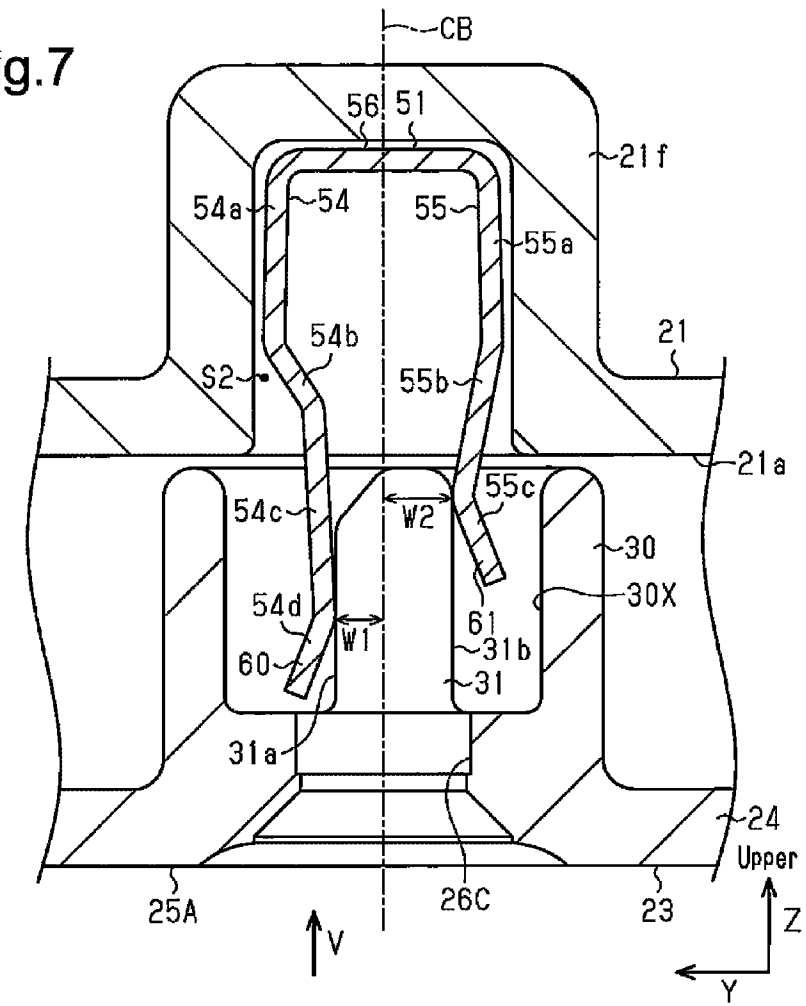
FIG. 7 is a sectional view of the outlet block.

As illustrated in FIG. 7, a rib 31 which is formed inside the recessed portion 30X of the socket cover 23 is in contact with the extension portions 60, 61. Specifically, a side face 31*a* of the rib 31 is in contact with an end portion (base end portion) of the extension portion 60 on the downstream side in the insertion direction V from the inside of the grounding blade receiving portion 51. Further, a side face 31*b* of the rib 31 is in contact with an end portion (base end portion) of the extension portion 61 on the downstream side in the insertion direction V from the inside of the grounding blade receiving portion 51. That is, the rib 31 which extends upward from the bottom face of the recessed portion 30X is inserted between the pair of extension portions 60, 61 and in contact with the pair of extension portions 60, 61. The rib 31 is in contact with the base end portions of the extension portions 60, 61, thereby pushing the extension portions 60, 61 outside to adjust a clearance (aperture amount) between the guide portions 54*d*, 55*c* with respect to the insertion axis CB.

Here, as illustrated in FIG. 4B, at the rib 31, a width W1 and a width W2, each of which extends laterally on both sides from a virtual line M1 extending along the front-and-back direction X through the center of the grounding insertion hole 26C in the lateral direction Y and also through the insertion axis CB, are different from each other. Specifically, the width W1 from the virtual line M1 to the side face 31*a* is shorter than the width W2 from the virtual line M1 to the side face 31*b*. Therefore, as illustrated in FIG. 7, when the rib 31 is brought into contact with the extension portions 60, 61, a clearance of the guide portion 54*d* with respect to the insertion axis CB is adjusted to the width W1, and a clearance of the guide portion 55*c* with respect to the insertion axis CB is adjusted to the width W2. Therefore, when the rib 31 is brought into contact with the extension portions 60, 61, adjustment is made so that the clearance of the guide portion 54*d* with respect to the insertion axis CB is shorter than the clearance of the guide portion 55*c* with respect to the insertion axis CB. In other words, when the rib 31 comes into contact with the extension portions 60, 61, adjustment is made so that the clearance of the guide portion 54*d* with respect to the insertion axis CB is shorter than the clearance of the guide portion 55*c* with respect to the insertion axis CB.

Figure 8:
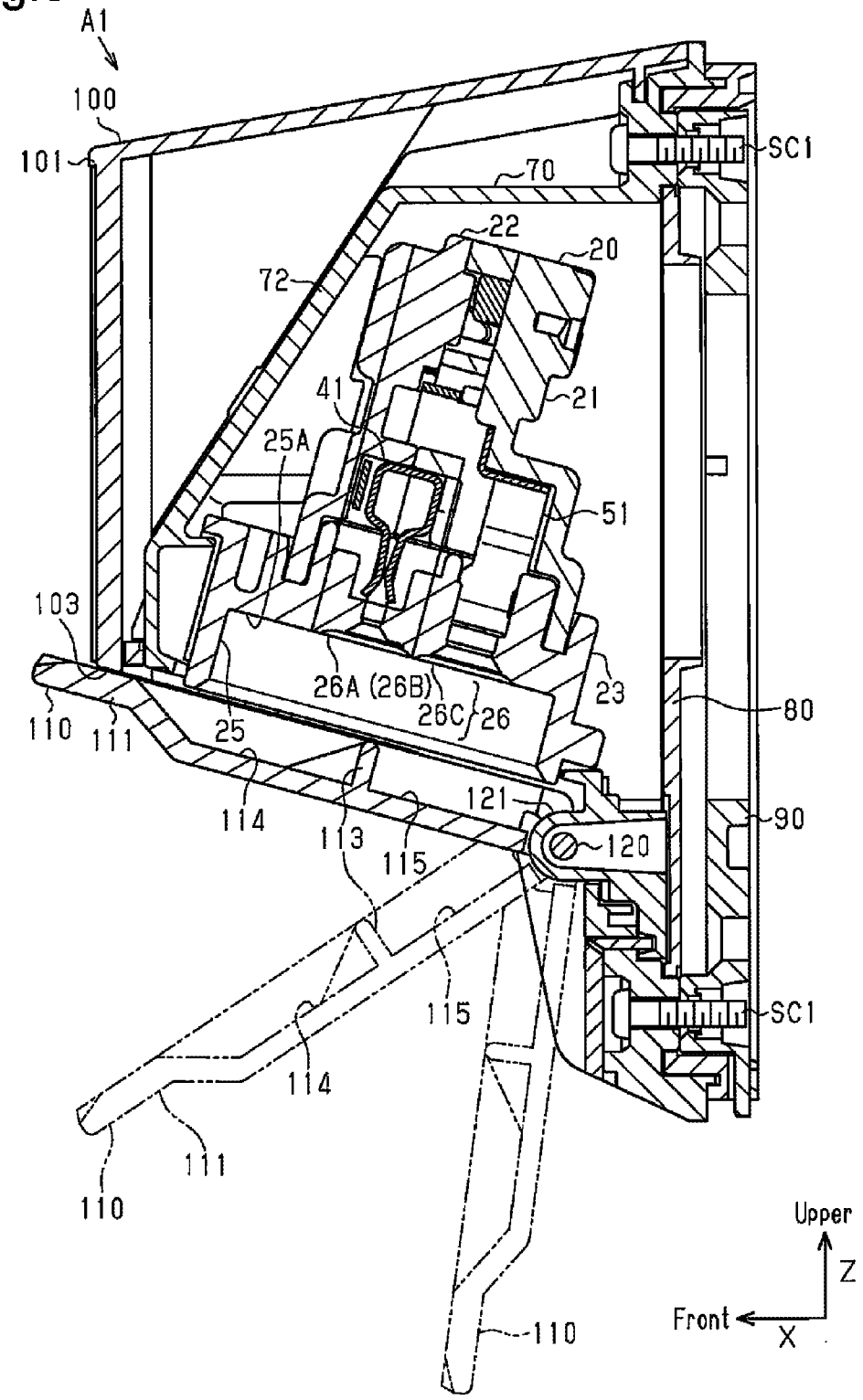
FIG. 8 is a sectional view of the receptacle outlet.

As illustrated in FIG. 8, the outlet block 20 which has been described so far is housed and retained in a retaining portion 72 of the body 70. At this time, the recessed portion 25 is opened downward and also disposed so as to incline downward in accordance with the incline rearward. Thereby, the bottom face 25A of the recessed portion 25 and the insertion port 26 are exposed downward.

Next, a description will be given of a structure of the shutter opening/closing mechanism 11.

As illustrated in FIG. 2, the shutter opening/closing mechanism 11 includes a shutter body 110 which performs opening/closing operations, a shaft 120 which is attached to the shutter body 110 and an axial body 121 which houses and retains the shaft 120. The axial body 121 is attached to the body 70 by a screw member SC2. A helical spring (spring) 122 which is an urging means for urging the shutter body 110 to the insertion port 26 (refer to FIG. 8) is attached to the shaft 120.

The shutter body 110 includes a base portion 111 which is formed in a flat plate shape. A recessed portion 112 which is recessed downward is installed at the center portion on an upper face of the base portion 111. At the center portion of the recessed portion 112 in the front-and-back direction X, there is installed a protruding portion 113 which protrudes upward from the bottom face of the recessed portion 112. At the recessed portion 112, a region on the further forward side than the protruding portion 113 is given as a regulating portion 114, and a region on the further rearward side than the protruding portion 113 is given as a fixing portion 115.

The shutter opening/closing mechanism 11 is such that the shaft 120 is inserted into an insertion hole 121*a* installed on the axial body 121 and the shutter body 110 is attached to the both sides of the shaft 120 in the lateral direction Y from the spring 122 in a state that the spring 122 is attached to the both sides of the shaft 120 in the lateral direction Y from the insertion hole 121*a*. Thereby, the shutter body 110 will rotate, with the shaft 120 being used as a rotation shaft. Specifically, as illustrated in FIG. 8, the shutter body 110 is able to rotate downward from a closed state that the shutter body 110 is in contact with a lower end face 103 of the peripheral wall portion 101 of the decorative cover 100 (refer to the solid line), with the shaft 120 used as the rotation shaft. Upon rotating downward in the closed state, the shutter body 110 is brought into an open state by being spaced away from the lower end face 103 (refer to the double dot and dashed line). In the closed state, the base portion 111 of the shutter body 110 protrudes forward and also in the lateral direction Y from the peripheral wall portion 101 substantially over an entire periphery of the peripheral wall portion 101. Further, in the closed state, the base portion 111 is kept in a state that the lower end face 103 is constantly pressed by the spring 122 (refer to FIG. 2).

Next, with reference to FIGS. 10A to 10C, 11A to 11D and 12, a description will be given of operations for connecting the plug B1 with the outlet A1.

Figure 10A:
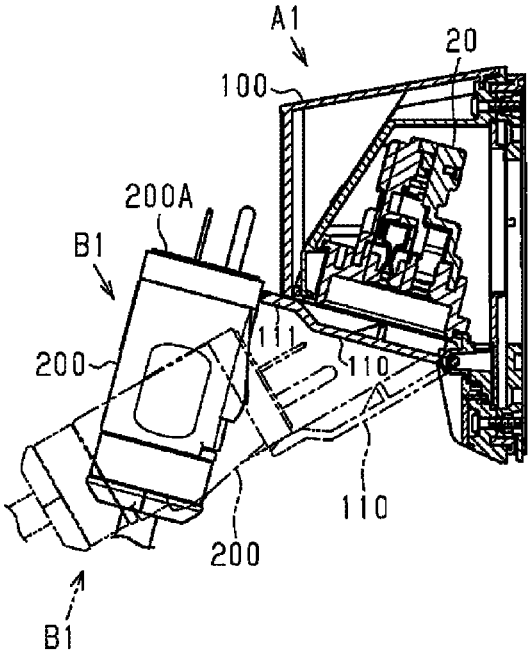
FIGS. 10A to 10C, 11A to 11D and 12 are pattern diagrams for explaining operations when the plug is inserted into the receptacle outlet.

As illustrated in FIG. 10A, a site which protrudes from the decorative cover 100 of the shutter body 110 is caught on the shutter body 110 which is in a closed state by using an end portion forward of the plug body 200, thereby rotating the shutter body 110 so as to bring it into an open state. As a method for bringing the shutter body 110 into the open state, the shutter body 110 may be rotated so as to bring it into the open state by the fingers of a user.

Figure 10B:
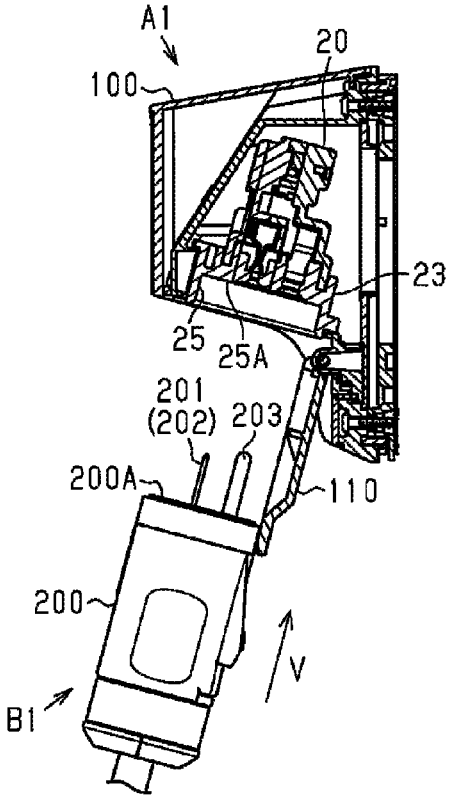

Next, as illustrated in FIG. 10B, the plug B1 is moved to a position at which the power-supply plug blades 201, 202 and the grounding plug blade 203 oppose the bottom face 25A of the recessed portion 25. And, the power-supply plug blades 201, 202 and the grounding plug blade 203 are inserted toward the socket cover 23 along the insertion direction V.

Figure 10C:
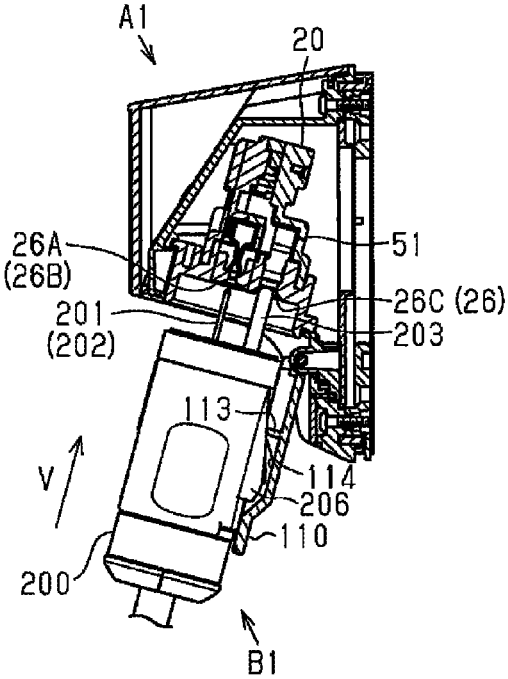

Then, as illustrated in FIG. 10C, when the plug B1 is further inserted along the insertion direction V, the protruding portion 206 of the plug B1 is housed in the regulating portion 114 of the shutter body 110. At this time, while the leading end of the grounding plug blade 203 is inserted into the grounding insertion hole 26C, the power-supply plug blades 201, 202 are positioned further on the upstream side in the insertion direction V than the power-supply insertion holes 26A, 26B.

Figure 11A:
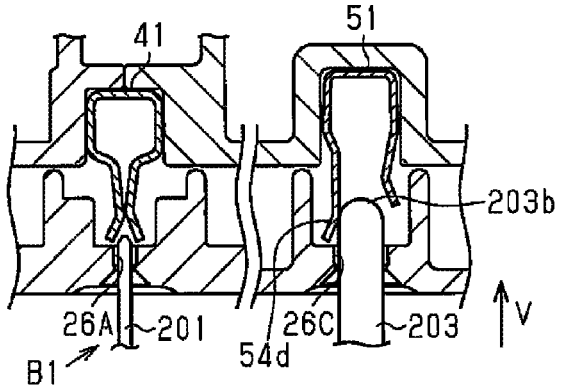

Then, as illustrated in FIG. 11A, when the plug B1 is further inserted along the insertion direction V, the leading end portion 203*b* of the grounding plug blade 203 comes into contact with the guide portion 54*d* of the grounding blade receiving portion 51. At this time, the leading end portion of the power-supply plug blade 201 is inserted into the power-supply insertion hole 26A. However, the power-supply plug blade 201 is not yet in contact with the power-supply blade receiving portion 41. That is, before the power-supply plug blade 201 is in contact with the power-supply blade receiving portion 41, the grounding plug blade 203 comes into contact with the grounding blade receiving portion 51.

Figure 11B:
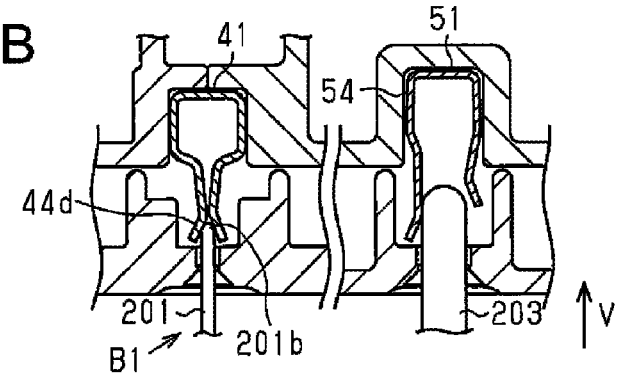

Then, as illustrated in FIG. 11B, when the plug B1 is further inserted along the insertion direction V, the leading end portion 201*b* of the power-supply plug blade 201 comes into contact with the guide portion 44*d* of the power-supply blade receiving portion 41. At this time, the power-supply plug blade 201 is in point contact with the power-supply blade receiving portion 41, and the power-supply plug blade 201 is not yet retained by the power-supply blade receiving portion 41. Further, at this time, although the grounding plug blade 203 is in contact with the grounding piece 54, it is not yet retained by the grounding blade receiving portion 51. That is, where the power-supply plug blade 201 is in point contact with the power-supply blade receiving portion 41, neither the power-supply plug blade 201 nor the grounding plug blade 203 is retained by the power-supply blade receiving portion 41 or the grounding blade receiving portion 51. Therefore, when a user releases his/her hand from the plug B1 in a state illustrated in FIG. 11B, the plug B1 is not retained by the outlet A1, and the plug B1 is detached from the outlet A1. Thereby, the plug B1 is prevented from being retained by the outlet A1 in a state that the power-supply plug blade 201 is in point contact with the power-supply blade receiving portion 41. Further, at this time, as illustrated in FIGS. 1A and 1B, the corner portion 25B, which is an opening edge portion of the recessed portion 25 into which the leading end portion of the plug B1 is inserted, is chamfered. It is, thereby, possible to prevent the leading end portion of the plug body 200 from being caught on the corner portion 25B.

In detail, there is a case where, when the plug B1 is detached from the outlet A1, an axial direction of the plug body 200 may be inclined from the insertion direction V due to tension of the cable 204 or the like, a pressing force from the shutter body 110 or the like. At this time, where the corner portion 25B is not chamfered, there is a possibility that the leading end portion of the plug body 200 is caught on the corner portion 25B and the plug B1 is retained by the outlet A1 in a state that the power-supply plug blade 201 is in point contact with the power-supply blade receiving portion 41. In contrast, in the present embodiment, even where an axial direction of the plug body 200 is inclined from the insertion direction V, the leading end portion of the plug body 200 can be favorably prevented from being caught on the corner portion 25B due to the fact that the corner portion 25B is chamfered. Therefore, it is possible to favorably prevent the plug B1 from being retained by the outlet A1 in a state that the power-supply plug blade 201 is in point contact with the power-supply blade receiving portion 41.

Figure 11C:
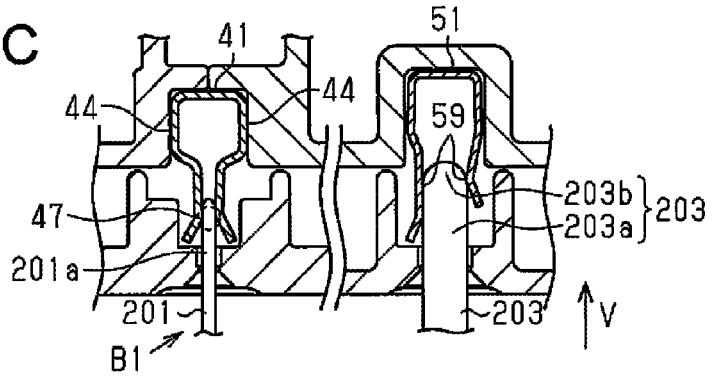

Next, as illustrated in FIG. 11C, when the plug B1 is further inserted along the insertion direction, the body portion 201*a* of the power-supply plug blade 201 is inserted further to the downstream side in the insertion direction V than the power-supply retaining portion 47 of the power-supply blade receiving portion 41. At this time, the power-supply plug blade 201 is inserted into the power-supply blade receiving portion 41 against an urging force coming from springs of the pair of holding plates 44. An interval between the power-supply retaining portions 47 which are bent in a less-than sign shape in a direction in which they come close to each other is widened due to insertion of the power-supply plug blade 201, by which the pair of holding plates 44 are deformed so as to move outside. At this time, an urging force based on deformation of the pair of holding plates 44 acts on the power-supply plug blade 201 as a contact pressure derived from the power-supply blade receiving portion 41. Thereby, the power-supply blade receiving portion 41 starts to retain the power-supply plug blade 201. On the other hand, in the present example, at the start of retaining the power-supply plug blade 201, the grounding plug blade 203 is not yet retained by the grounding blade receiving portion 51. Specifically, at the start of retaining the power-supply plug blade 201, the leading end portion 203*b* of the grounding plug blade 203 is inserted further to the downstream side in the insertion direction V than the grounding retaining portion 59. However, the body portion 203*a* with which the grounding retaining portion 59 is elastically in contact is not inserted up to the grounding retaining portion 59.

Figure 11D:
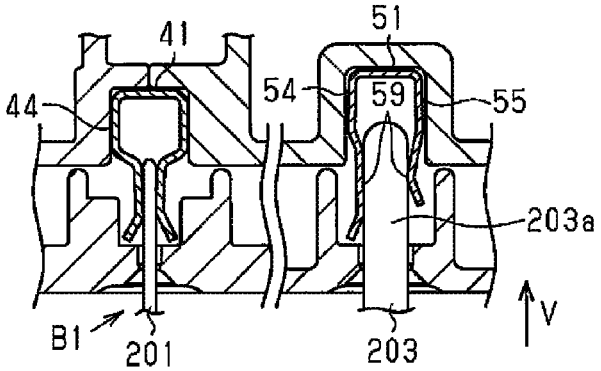

Then, as illustrated in FIG. 11D, when the plug B1 is further inserted along the insertion direction V, the body portion 203*a* of the grounding plug blade 203 is inserted further to the downstream side in the insertion direction V than the grounding retaining portion 59 of the grounding blade receiving portion 51. At this time, the grounding plug blade 203 is inserted into the grounding blade receiving portion 51 against an urging force coming from springs of the pair of grounding pieces 54, 55. An interval between the grounding retaining portions 59 is widened due to insertion of the grounding plug blade 203, and the pair of grounding pieces 54, 55 are deformed so as to move outside. At this time, an urging force based on deformation of the pair of grounding pieces 54, 55 acts on the grounding plug blade 203 as a contact pressure from the grounding blade receiving portion 51. Thereby, the grounding blade receiving portion 51 starts to retain the grounding plug blade 203. In the present example, after the power-supply plug blade 201 is retained by the power-supply blade receiving portion 41, the grounding plug blade 203 is retained by the grounding blade receiving portion 51.

Figure 12:
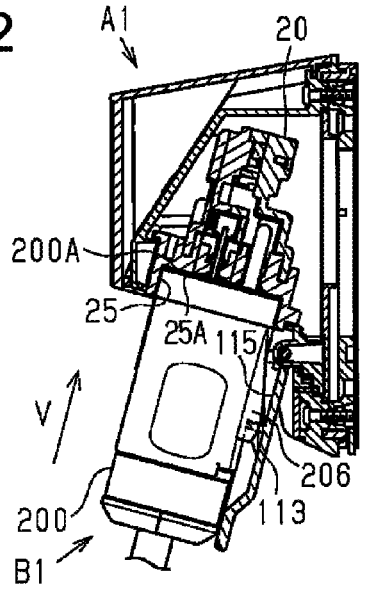

Then, as illustrated in FIG. 12, when the plug B1 is further inserted along the insertion direction V, the leading end face 200A of the plug body 200 is brought into contact with the bottom face 25A of the recessed portion 25. At this time, the protruding portion 206 of the plug body 200 is housed in the fixing portion 115 of the shutter body 110. Thereby, the plug B1 is completely connected to the outlet A1.

The present embodiment provides the following effects.

(1) The base end portion of the guide portion 54*d* at the grounding blade receiving portion 51 and the base end portion of the guide portion 44*d* at the power-supply blade receiving portion 41 are disposed so as to be on the same plane orthogonal to the insertion axes CA, CB. Further, the grounding retaining portion 59 is installed further on the downstream side in the insertion direction V than the power-supply retaining portion 47 by the distance L2 longer than the distance L1 which is a difference in the protrusion amount between the grounding plug blade 203 and the power-supply plug blades 201, 202. Thereby, when inserting the plug B1 into the outlet A1, before the power-supply plug blades 201, 202 are brought into contact with the power-supply blade receiving portion 41, the grounding plug blade 203 is brought into contact with the grounding blade receiving portion 51. Further, after the power-supply blade receiving portion 41 has started to retain the power-supply plug blades 201, 202, the grounding blade receiving portion 51 can start to retain the grounding plug blade 203. Therefore, in a state that the power-supply plug blades 201, 202 are not retained by the power-supply blade receiving portion 41, the grounding plug blade 203 is not retained by the grounding blade receiving portion 51 as well. It is, thus, possible to favorably prevent the plug B1 from being retained by the outlet A1 in a state that the power-supply plug blades 201, 202 are in point contact with the power-supply blade receiving portion 41. As a result, it is possible to favorably prevent generation of high heat between the outlet A1 and the plug B1.

(2) The grounding piece 55 is made shorter in entire length than the grounding piece 54. It is, thereby, possible to reduce material costs of the outlet A1 compared to a case where the grounding piece 55 is equal in entire length to the grounding piece 54.

(3) Further, the guide portion 55*c* can be made shorter compared to a case where the grounding piece 55 is equal in entire length to the grounding piece 54. It is, thereby, possible to favorably prevent the grounding blade receiving portion 51 from being widened in the lateral direction Y even where the guide portion 55*c* is set to have a wide aperture angle θ1.

(4) Still further, the guide portion 55*c* is set to have a wide aperture angle θ1, thus making it possible to increase a repulsive force against the grounding plug blade 203 moving from downstream to upstream in the insertion direction V. It is, thereby, possible to favorably prevent the grounding plug blade 203 from being detached.

(5) The protrusion amount L3 is set to be smaller than the protrusion amount L4 in such a manner that a contact pressure acting on the grounding plug blade 203 from the grounding piece 54 is made equal to that acting thereon from the grounding piece 55 which is different in length from the grounding piece 54. Thereby, the grounding plug blade 203 can be stably retained by the pair of grounding pieces 54, 55.

(6) There is installed the rib 31 which is in contact with the extension portions 60, 61 to adjust so that a clearance of the guide portion 54*d* with respect to the insertion axis CB is shorter than a clearance of the guide portion 55*c* with respect to the insertion axis CB. Thereby, the guide portion 54*d* is made closer to the insertion axis CB. As a result, even where only the guide portion 54*d* which is one side of the grounding pieces 54, 55 is used to guide insertion of the grounding plug blade 203, it is possible to favorably bring the grounding plug blade 203 into contact with the guide portion 54*d*.

(7) The corner portion 25B between the inner wall of the recessed portion 25 and the lower face 24A of the socket cover 23 is chamfered. Thereby, it is possible to favorably prevent the plug B1 from being retained by the outlet A1 in a state that the power-supply plug blade 201 is in point contact with the power-supply blade receiving portion 41.

The above-described embodiment may be modified as follows.

Figure 13:
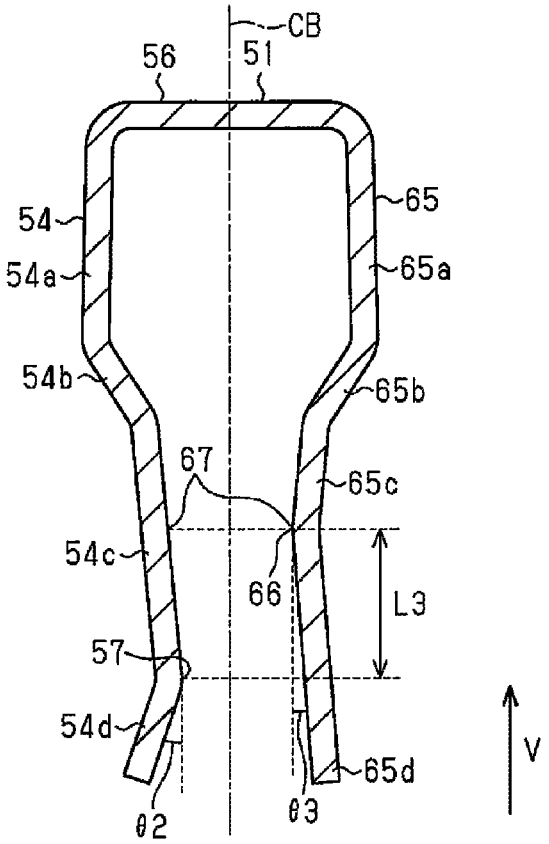
FIG. 13 is a sectional view illustrating a grounding blade receiving portion in a modification.
Figure 14A:
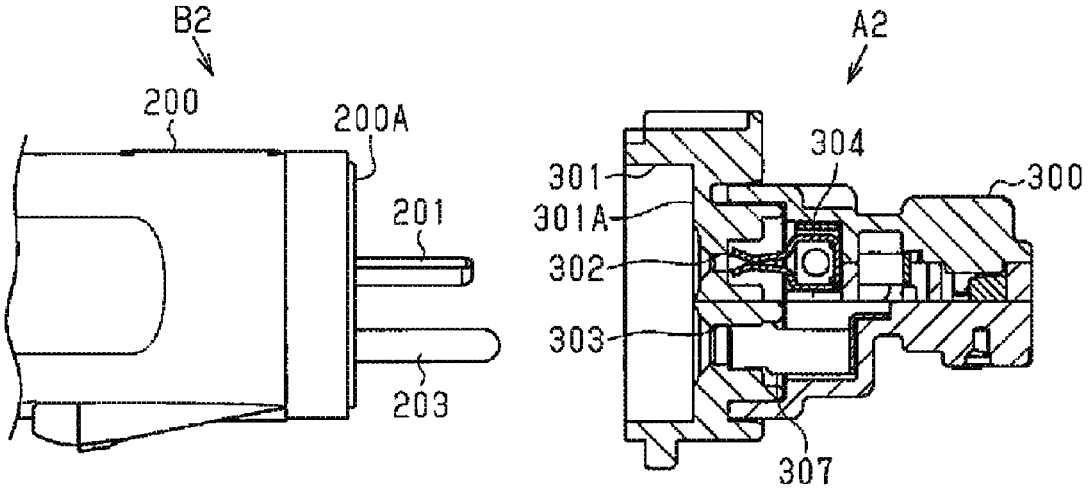
FIG. 14A is a pattern diagram of a conventional plug and a receptacle outlet.
Figure 14B:
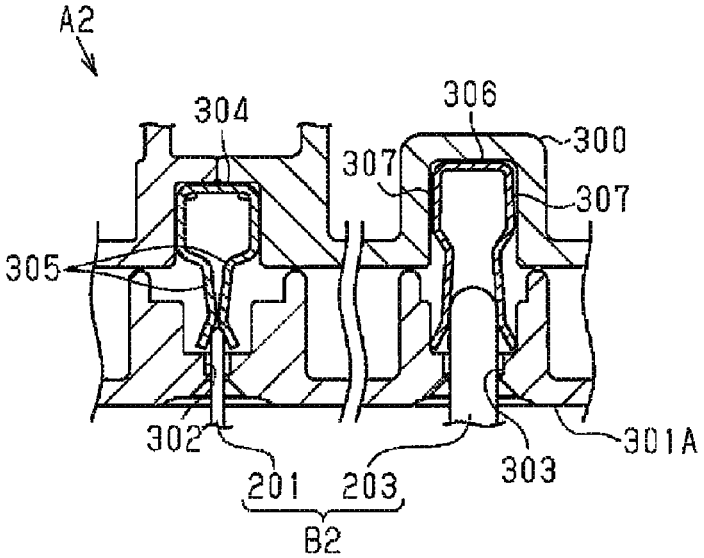
FIG. 14B is a developed view in which the conventional receptacle outlet is developed on a plane and shown.

The grounding blade receiving portion 51 may be changed in structure, as illustrated in FIG. 13. The grounding blade receiving portion 51 includes a pair of grounding pieces 54, 65 which oppose each other to hold the grounding plug blade 203 therebetween with elastic force and a coupling portion 56 which couples the base end portion of the grounding piece 54 with the base end portion of the grounding piece 65. The grounding piece 65 is substantially equal in entire length to the grounding piece 54. As with the above-described embodiment, the connection portion 57 of the grounding piece 54 and the power-supply retaining portion 47 (refer to FIG. 5) are disposed on the same plane orthogonal to the insertion axis CB.

The grounding piece 65 includes a base portion 65*a* which is connected to the coupling portion 56, bending portions 65*b*, 65*c* which are bent from the base portion 65*a* to the grounding piece 54 and a guide portion 65*d* which is bent from the bending portion 65*c* to a direction which is spaced away from the grounding piece 54.

The bending portion 65*b* is bent so as to come close to the grounding piece 54 as it moves from the leading end portion of the base portion 65*a* to the upstream side in the insertion direction V. The bending portion 65*c* is bent so as to come close to the grounding piece 54 as it moves from the leading end portion of the bending portion 65*b* to the upstream side with respect to the insertion direction V. The bending portion 65*b* is formed so that an inclination angle thereof with respect to the insertion direction V is greater than that of the bending portion 65*c*. The guide portion 65*d* is bent so as to be spaced away from the grounding piece 54 as it moves from the leading end portion of the bending portion 65*c* to the upstream side in the insertion direction V. Therefore, the connection portion 66 which connects the bending portion 65*c* with the guide portion 65*d* is bent in a less-than sign shape in a direction that comes close to the grounding piece 54 and the insertion axis CB. The connection portion 66 is installed so as to oppose a midpoint part of the bending portion 54*c*. A part at which the connection portion 66 and the bending portion 54*c* opposes each other is a part at which an interval between the pair of grounding pieces 54, 65 becomes the narrowest and they oppose each other at an interval narrower than the diameter of the body portion 203*a* of the grounding plug blade 203 (refer to FIG. 5). Then, in the grounding blade receiving portion 51, a part at which the connection portion 66 and the bending portion 54*c* oppose each other is given as a grounding retaining portion 67 which is elastically in contact with the grounding plug blade 203 and become conductive. The grounding retaining portion 67 is installed further on the downstream side in the insertion direction V than the connection portion 57 by the distance L2 equal to or more than the distance L1 which is a difference in the protrusion amount between the grounding plug blade 203 and the power-supply plug blade 201. Therefore, the grounding retaining portion 67 is installed on the downstream side in the insertion direction V in a position which is apart by the distance L1 or more from the power-supply retaining portion 47 (refer to FIG. 5).

In the present example, an aperture angle θ3 of the guide portion 65*d* with respect to a virtual line (refer to the dashed line) extending along the insertion direction V is set so as to be smaller than the aperture angle θ2 of the guide portion 54*d*. It is, thereby, possible to favorably prevent the grounding blade receiving portion 51 from being widened in the lateral direction Y.

Even where the above-described grounding blade receiving portion 51 is adopted, it is possible to obtain the effect of (1) of the above-described embodiment. Further, in order to guide the grounding plug blade 203 by the pair of guide portions 54*d*, 65*d* which oppose each other, when the grounding plug blade 203 is guided to the grounding retaining portion 67, the pair of guide portion 54*d*, 65*d* are favorably brought into contact with the grounding plug blade 203.

In the above-described embodiment, the guide portion 54*d* is bent in a direction in which the insertion axis CB is spaced away from the leading end portion of the bending portion 54*c*. Not limited to this, for example, the guide portion 54*d* may be bent so as to extend from the leading end portion of the bending portion 54*c* in a direction along the insertion direction V.

In the above-described embodiment, the guide portion 55*c* which serves as a grounding contact portion and the guide portion 44*d* which serves as a power-supply contact portion are disposed on the same plane orthogonal to the insertion axes CA, CB. Not limited to this, for example, the guide portion 55*c* may be installed further on the upstream side in the insertion direction V than the guide portion 44*d*. Further, the guide portion 55*c* may be installed further on the downstream side in the insertion direction V than the guide portion 44*d*. However, in this case, in order that the grounding plug blade 203 is brought into contact with the guide portion 55*c* before the guide portion 44*d* is brought into contact with the power-supply plug blades 201, 202, it is necessary that a clearance between the guide portion 55*c* and the guide portion 44*d* along the insertion direction V is set to be less than the distance L1.

In the above-described embodiment, in order that the grounding plug blade 203 is retained by the grounding blade receiving portion 51 after the power-supply plug blades 201, 202 are retained by the power-supply blade receiving portion 41, the distance L2 is set to a distance longer than the distance L1. Not limited to this, for example, the distance L2 may be set to a distance equal to the distance L1 and substantially at the same time when the power-supply blade receiving portion 41 starts to retain the power-supply plug blades 201, 202, the grounding blade receiving portion 51 may start to retain the grounding plug blade 203.

In the above-described embodiment, the grounding plug blade 203 is retained by the pair of grounding pieces 54, 55. However, there is no particular restriction on the number of grounding pieces. For example, three or more grounding pieces may be used to retain the grounding plug blade 203. Further, a single tubular blade receiving structure may be used to retain the grounding plug blade 203.

R chamfering (round chamfer) may be performed on the corner portion 25B. Chamfering performed on the corner portion 25B may be omitted.

The outlet A1 may be installed indoors or outdoors.

The disclosure further encompasses various example(s) described below.

[Clause 1] A socket for use with a plug including a plug body, a pair of power-supply plug blades that protrude from a leading end face of the plug body, and a grounding plug blade that protrudes from the leading end face by a certain distance from the power-supply plug blades, the socket comprising: a pair of power-supply blade receivers adapted to retain the pair of power-supply plug blades, and a grounding blade receiver adapted to retain the grounding plug blade, wherein each of the power-supply blade receivers includes a power-supply retaining portion configured to elastically and conductively retain the corresponding power-supply plug blade and a power-supply contact portion which is installed further on the upstream side in the insertion direction of the corresponding power-supply plug blade and the grounding plug blade than the power-supply retaining portion to contact with the corresponding power-supply plug blade, the grounding blade receiver includes a grounding retaining portion configured to elastically and conductively retain the grounding plug blade and a grounding contact portion which is installed further on the upstream side in the insertion direction than the grounding retaining portion to contact with the grounding plug blade, the grounding contact portion is installed further on the upstream side in the insertion direction than a position which is spaced away from the power-supply contact portion to the downstream side in the insertion direction by less than the certain distance, and the grounding retaining portion is spaced away by the certain distance or more from the power-supply retaining portion to the downstream side in the insertion direction.

[Clause 2] In some implementations, the grounding blade receiver includes a first grounding piece and a second grounding piece which oppose each other to hold the grounding plug blade therebetween and a coupling portion which couples a base end portion of the first grounding piece with a base end portion of the second grounding piece, the first grounding piece includes a first base portion connected to the coupling portion, a first bending portion which is bent from the first base portion to the second grounding piece and the grounding contact portion which is bent from the first bending portion to a direction which is spaced away from the second grounding piece, the second grounding piece includes a second base portion connected to the coupling portion, a second bending portion which is bent from the second base portion to the first grounding piece and a guide portion which is bent from the second bending portion to a direction which is spaced away from the first grounding piece, a connection portion which connects the second bending portion with the guide portion and the first bending portion which opposes the connection portion are given as the grounding retaining portion, and the grounding retaining portion is installed on the downstream side in the insertion direction in a position which is spaced away by the certain distance or more from the connection portion which connects the first bending portion with the grounding contact portion.

[Clause 3] In some implementations, the second grounding piece is shorter in entire length than the first grounding piece by the certain distance or more.

[Clause 4] In some implementations, a first protrusion amount which is a distance from the base end portion of the second grounding piece to the leading end portion of the second bending portion toward the first grounding piece is smaller than a second protrusion amount which is a distance from the base end portion of the first grounding piece to the grounding retaining portion of the first grounding piece toward the second grounding piece.

[Clause 5] In some implementations, the first protrusion amount is less than the second protrusion amount to equalize contact pressure of the first grounding piece acting on the grounding plug blade with contact pressure of the second grounding piece acting on the grounding plug blade.

[Clause 6] In some implementations, an aperture angle of the guide portion with respect to an axis extending along the insertion direction is equal in angle to an aperture angle of the grounding contact portion with respect to the axis.

[Clause 7] In some implementations, the second grounding piece is equal in entire length to the first grounding piece, and an aperture angle of the guide portion with respect to an axis extending along the insertion direction is smaller than an aperture angle of the grounding contact portion with respect to the axis.

[Clause 8] In some implementations, the receptacle includes a receptacle main body forming a housing chamber which houses the grounding blade receiver. The housing chamber is provided with a rib which is inserted between the guide portion and the grounding contact portion and brought into contact with a part of the guide portion and a part of the grounding contact portion, thereby adjusting a clearance of the grounding contact portion with respect to an insertion axis of the grounding plug blade is shorter than a clearance of the guide portion with respect to the insertion axis.

[Clause 9] In some implementations, the socket includes a receptacle main body including a lower face provided with a recessed portion configured to receive the leading end portion of the plug body. The recessed portion includes an inner wall. A chamfered corner portion is formed between the inner wall of the recessed portion and the lower face of the receptacle main body.

The following is a list of reference numerals.

A1 . . . receptacle outlet (socket); B1 . . . plug; 10 . . . receptacle main body; 20 . . . outlet block (receptacle main body); 25 . . . recessed portion; 25B . . . corner portion; 31 . . . rib; 41 . . . power-supply blade receiving portion; 44*d* . . . guide portion (power-supply contact portion); 47 . . . power-supply retaining portion; 51 . . . grounding blade receiving portion; 54 . . . grounding piece (first grounding piece); 54*a* . . . base portion (first base portion); 54*b*, 54*c* . . . bending portion (first bending portion); 54*d* . . . guide portion (grounding contact portion); 55 . . . grounding piece (second grounding piece); 55*a*, 65*a* . . . base portion (second base portion); 55*b*, 65*b*, 65*c* . . . bending portion (second bending portion); 55*c*, 65*d* . . . guide portion; 56 . . . coupling portion; 57, 58 . . . connection portion; 59, 67 . . . grounding retaining portion; 200 . . . plug body; 201, 202 . . . power-supply plug blade; 203 . . . grounding plug blade; and S2 . . . housing chamber.

The invention is not limited to the foregoing embodiments and various changes and modifications of its components may be made without departing from the scope of the present invention. Also, the components disclosed in the embodiments may be assembled in any combination for embodying the present invention. For example, some of the components may be omitted from all components disclosed in the embodiments. Further, components in different embodiments may be appropriately combined. The scope of the present invention and equivalence of the present invention are to be understood with reference to the appended claims.

The invention claimed is:

1. A socket for use with a plug including a plug body, a pair of power-supply plug blades that protrude from a leading end face of the plug body, and a grounding plug blade that protrudes from the leading end face by a first distance from the power-supply plug blades, the socket comprising:

a socket cover including a recessed portion configured to receive a part of the plug body, the recessed portion including a bottom face, which faces to the leading end face of the plug body when the recessed portion receives the part of the plug body, wherein the bottom face is provided with a pair of power-supply insertion holes and a grounding insertion hole, the power-supply insertion holes each having a first plug insertion axis and the grounding insertion hole having a second plug insertion axis;

a pair of power-supply blade receivers disposed in the power-supply insertion holes and configured to retain the pair of power-supply plug blades; and a grounding blade receiver disposed in the grounding insertion hole and configured to retain the grounding plug blade, wherein:

each of the pair of power-supply blade receivers includes:

a pair of holding plates which oppose each other and include a power-supply contact portion which is a portion of at least one of the pair of holding plates that first comes into contact with a corresponding power-supply plug blade inserted through a corresponding power-supply insertion hole; and a power-supply retaining portion which forms a narrowest space between the pair of holding plates and is configured to elastically sandwich and conductively retain the corresponding power-supply plug blade therebetween, the grounding blade receiver includes:

a first grounding piece and a second grounding piece which oppose each other, the first and second grounding pieces including a grounding contact portion which is a portion, of at least one of the first and second grounding pieces, that is arranged so as to first come into contact with the grounding plug blade inserted through the grounding insertion hole, and a grounding retaining portion which forms a narrowest space between the first and second grounding pieces and is configured to elastically sandwich and conductively retain the grounding plug blade therebetween, the power-supply contact portion is arranged in the corresponding power-supply insertion holes at a first depth from the bottom face of the recessed portion along the first plug insertion axis, the power-supply retaining portion is arranged in the corresponding power-supply insertion holes at a second depth from the bottom face of the recessed portion along the first plug insertion axis, the grounding contact portion is arranged in the grounding insertion hole at a third depth from the bottom face of the recessed portion along the second plug insertion axis, the third depth being equal to or greater than the first depth and less than a total of the first depth and the first distance, the grounding retaining portion is arranged in the grounding insertion hole at a fourth depth from the bottom face of the recessed portion along the second plug insertion axis, the fourth depth being greater than the third depth, and the fourth depth is greater than the second depth by a second distance that is equal to or greater than the first distance.

2. The socket according to claim 1, wherein the grounding blade receiver includes a coupling portion which couples a base end portion of the first grounding piece with a base end portion of the second grounding piece, the first grounding piece includes a first base portion connected to the coupling portion, a first bending portion which is bent from the first base portion in such a manner that the first bending portion comes close to the second grounding piece and the grounding contact portion which is bent from the first bending portion to a direction which is spaced away from the second grounding piece, the second grounding piece includes a second base portion connected to the coupling portion, a second bending portion which is bent from the second base portion in such a manner that the second bending portion comes close to the first grounding piece and a guide portion which is bent from the second bending portion to a direction which is spaced away from the first grounding piece, a connection portion which connects the second bending portion with the guide portion and the first bending portion which opposes the connection portion are given as the grounding retaining portion, and the grounding retaining portion is spaced away by the first distance or more from the connection portion which connects the first bending portion with the grounding contact portion in the second plug insertion axis.

3. The socket according to claim 2, wherein the second grounding piece is shorter in entire length than the first grounding piece by a certain length that is equal to or greater than the first distance.

4. The socket according to claim 3, wherein a first protrusion amount which is a distance from the base end portion of the second grounding piece to the leading end portion of the second bending portion toward the first grounding piece is smaller than a second protrusion amount which is a distance from the base end portion of the first grounding piece to the grounding retaining portion of the first grounding piece toward the second grounding piece.

5. The socket according to claim 4, wherein the first protrusion amount is less than the second protrusion amount to equalize contact pressure of the first grounding piece acting on the grounding plug blade with contact pressure of the second grounding piece acting on the grounding plug blade.

6. The socket according to claim 3, wherein an aperture angle of the guide portion with respect to an axis extending along the insertion direction is equal in angle to an aperture angle of the grounding contact portion with respect to the axis.

7. The socket according to claim 2, wherein the second grounding piece is equal in entire length to the first grounding piece, and an aperture angle of the guide portion with respect to an axis extending along the insertion direction is smaller than an aperture angle of the grounding contact portion with respect to the axis.

8. The socket according to claim 2, further comprising a receptacle main body forming a housing chamber which houses the grounding blade receiver, wherein the housing chamber is provided with a rib which is disposed between the guide portion and the grounding contact portion in a manner such that the rib contacts with a part of the guide portion and a part of the grounding contact portion to form a first clearance between the grounding contact portion and the second plug insertion axis and a second clearance between the guide portion and the second plug insertion axis, the first clearance being shorter than the second clearance.

9. The socket according to claim 1, further comprising a receptacle main body including a lower face provided with the recessed portion, wherein the recessed portion includes an inner side wall around the bottom face, and a chamfered corner portion is formed between the inner wall of the recessed portion and the lower face of the receptacle main body.

10. The socket according to claim 1, wherein the pair of holding plates of each power-supply blade receiver is configured to come in surface contact with the corresponding power-supply plug blade at the power-supply retaining portion when the grounding blade receiver starts elastically sandwiching the grounding plug blade at the grounding retaining portion.

11. The socket according to claim 1, wherein the second distance is set determined such that the power-supply retaining portion elastically sandwiches the corresponding power-supply plug blade therebetween whenever the grounding blade receiver elastically sandwiches the grounding plug blade at the grounding retaining portion therebetween.

12. A socket for use with a plug including a plug body, first and second power-supply plug blades that protrude from a leading end face of the plug body, and a grounding plug blade that protrudes from the leading end face by a first distance from the first and second power-supply plug blades, the socket comprising:

a socket cover including a recessed portion configured to receive a part of the plug body, the recessed portion including a bottom face, wherein:

the socket includes a first power-supply portion, a second power-supply portion and grounding portion, the first power supply portion includes:

a first power-supply insertion hole disposed at the bottom face of the recessed portion and having a first plug insertion axis; and a power-supply blade receiver disposed in the first power-supply insertion hole and configured to retain the first power-supply plug blade;

the grounding portion includes:

the grounding insertion hole disposed at the bottom face of the recessed portion and having a second plug insertion axis; and a grounding blade receiver disposed in the grounding insertion hole and configured to retain the grounding plug blade, the power-supply blade receiver includes a pair of holding plates, and has:

a power-supply contact portion which is a portion that first comes into contact with the first power-supply plug blade inserted through the first power-supply insertion hole; and a power-supply retaining portion which forms a narrowest space between the pair of holding plates and is configured to elastically sandwich and conductively retain the first power-supply plug blade therebetween, the grounding blade receiver includes a first grounding piece and a second grounding piece which oppose each other, the first grounding piece has a grounding contact portion which is a portion that is arranged so as to first come into contact with the grounding plug blade inserted through the grounding insertion hole, the grounding blade receiver has a grounding retaining portion which forms a narrowest space between the first and second grounding pieces and is configured to elastically sandwich and conductively retain the grounding plug blade therebetween, the power-supply contact portion is located at a first depth from the bottom face of the recessed portion along the first plug insertion axis, the power-supply retaining portion is located at a second depth from the bottom face of the recessed portion along the first plug insertion axis, the grounding contact portion is located at a third depth from the bottom face of the recessed portion along the second plug insertion axis, the third depth being equal to or greater than the first depth and less than a total of the first depth and the first distance, the grounding retaining portion is located at a fourth depth from the bottom face of the recessed portion along the second plug insertion axis, the fourth depth being greater than the third depth, and the fourth depth is greater than the second depth by a second distance that is equal to or greater than the first distance.

13. An connector, comprising a socket; and a plug including a plug body, first and second power-supply plug blades that protrude from a leading end face of the plug body, and a grounding plug blade that protrudes from the leading end face by a first distance from the first and second power-supply plug blades, wherein:

the socket comprises a socket cover including a recessed portion configured to receive a part of the plug body, the recessed portion including a bottom face, the socket includes a first power-supply portion, a second power-supply portion and grounding portion, the first power supply portion includes:

a first power-supply insertion hole disposed at the bottom face of the recessed portion and having a first plug insertion axis; and a power-supply blade receiver disposed in the first power-supply insertion hole and configured to retain the first power-supply plug blade;

the grounding portion includes:

the grounding insertion hole disposed at the bottom face of the recessed portion and having a second plug insertion axis; and a grounding blade receiver disposed in the grounding insertion hole and configured to retain the grounding plug blade, the power-supply blade receiver includes a pair of holding plates, and has:

a power-supply contact portion which is a portion that first comes into contact with the first power-supply plug blade inserted through the first power-supply insertion hole; and a power-supply retaining portion which forms a narrowest space between the pair of holding plates and is configured to elastically sandwich and conductively retain the first power-supply plug blade therebetween, the grounding blade receiver includes a first grounding piece and a second grounding piece which oppose each other, the first grounding piece has a grounding contact portion which is a portion that is arranged so as to first come into contact with the grounding plug blade inserted through the grounding insertion hole, the grounding blade receiver has a grounding retaining portion which forms a narrowest space between the first and second grounding pieces and is configured to elastically sandwich and conductively retain the grounding plug blade therebetween, the power-supply contact portion is located at a first depth from the bottom face of the recessed portion along the first plug insertion axis, the power-supply retaining portion is located at a second depth from the bottom face of the recessed portion along the first plug insertion axis, the grounding contact portion is located at a third depth from the bottom face of the recessed portion along the second plug insertion axis, the third depth being equal to or greater than the first depth and less than a total of the first depth and the first distance, the grounding retaining portion is located at a fourth depth from the bottom face of the recessed portion along the second plug insertion axis, the fourth depth being greater than the third depth, and the fourth depth is greater than the second depth by a second distance that is equal to or greater than the first distance.

* * * * *